US010428638B2

(12) United States Patent
Miller

(10) Patent No.: US 10,428,638 B2
(45) Date of Patent: Oct. 1, 2019

(54) SYSTEM AND METHOD FOR CONTROLLING A DRILLING MACHINE

(71) Applicant: Atlas Copco Drilling Solutions LLC, Garland, TX (US)

(72) Inventor: Peter D. Miller, Rockwall, TX (US)

(73) Assignee: Epiroc Drilling Solutions, LLC, Garland, TX (US)

( * ) Notice: Subject to any disclaimer, the term of this patent is extended or adjusted under 35 U.S.C. 154(b) by 276 days.

(21) Appl. No.: 15/465,798

(22) Filed: Mar. 22, 2017

(65) Prior Publication Data

US 2018/0156022 A1 Jun. 7, 2018

Related U.S. Application Data

(60) Provisional application No. 62/430,568, filed on Dec. 6, 2016.

(51) Int. Cl.

| | |
|---|---|
| ***E21B 44/00*** | (2006.01) |
| ***E21B 44/04*** | (2006.01) |
| ***E21D 9/00*** | (2006.01) |
| *E21C 37/00* | (2006.01) |
| *E21B 7/02* | (2006.01) |

(52) U.S. Cl.

CPC ..... *E21B 44/04* (2013.01); *E21D 9/006* (2013.01); *E21B 7/02* (2013.01); *E21C 37/00* (2013.01)

(58) Field of Classification Search

CPC ..... E21B 44/00; E21B 45/00; E21B 49/003
See application file for complete search history.

(56) References Cited

U.S. PATENT DOCUMENTS 3,752,966 A * 8/1973 Foy, Jr. ..... E21B 44/00 175/40
5,449,047 A * 9/1995 Schivley, Jr. ..... E21B 44/00 173/11
6,186,248 B1 2/2001 Silay et al.
(Continued)

FOREIGN PATENT DOCUMENTS

WO 2009123535 A1 10/2009

OTHER PUBLICATIONS

Dunlop, J., Optimizing ROP through automation, Drilling Contractor Magazine, Sep./Oct. 2011, vol. 67, No. 5, pp. 80-86, Houston, Texas.

*Primary Examiner* — Kipp C Wallace
(74) *Attorney, Agent, or Firm* — John A. Thomas

(57) ABSTRACT

A system and method for drilling a borehole using a drilling rig having a rotary drill bit includes monitoring one or more drilling parameters; determining whether the one or more monitored drilling parameters are within predetermined specifications for one or more of the monitored drill parameters; and, executing an exception control procedure for control of a drilling parameter. The exception control procedure receives an input sensor value associated with a drilling parameter and applies feedback control to establish a scaled error value that is used to compute a setting value for the drilling parameter. The drilling parameters controlled may include the rotation speed of the drill bit, the feed rate of the drill bit, the weight-on-bit, or rotation torque during retraction of the drill bit. A computer-readable database of specifications of drill bits may be provided as a part of the system.

11 Claims, 23 Drawing Sheets

(56) References Cited

U.S. PATENT DOCUMENTS

| | | | | |
|---|---|---|---|---|
| 7,413,031 | B2 | 8/2008 | Koch et al. | |
| 7,645,124 | B2 * | 1/2010 | Garlow | F04B 49/20 417/44.1 |
| 8,274,399 | B2 | 9/2012 | Strachan et al. | |
| 8,590,635 | B2 | 11/2013 | Koederitz | |
| 10,221,671 | B1 * | 3/2019 | Zhang | E21B 44/00 |
| 2004/0062658 | A1 * | 4/2004 | Beck | E21B 43/126 417/42 |
| 2011/0024189 | A1 | 2/2011 | Saeed et al. | |
| 2011/0108324 | A1 | 5/2011 | Stacy, II et al. | |
| 2013/0105221 | A1 | 5/2013 | Wassell | |
| 2014/0077964 | A1 | 3/2014 | Beligere et al. | |
| 2014/0360779 | A1 * | 12/2014 | Kyllingstad | E21B 41/0092 175/24 |
| 2016/0273332 | A1 * | 9/2016 | Dwars | E21B 44/00 |

* cited by examiner

SYSTEM AND METHOD FOR CONTROLLING A DRILLING MACHINE

CLAIM FOR PRIORITY

This application claims the priority of U.S. Provisional Patent Application, Ser. No. 62/430,568, filed Dec. 6, 2016.

BACKGROUND

Technical Field

This disclosure relates to methods and systems for drilling boreholes in the earth in general, and more specifically, to methods and systems for drilling blast holes of the type commonly used in mining and quarrying operations.

Background

Various systems and methods for drilling boreholes are known in the art and have been used for decades in a wide variety of applications, for example, from oil and gas production, to mining, to quarrying operations. In mining and quarrying operations, such boreholes are typically filled with an explosive that, when detonated, ruptures or fragments the surrounding rock. Thereafter, the fragmented material can be removed and processed in a manner consistent with the particular operation. When used for this purpose, then, such boreholes are commonly referred to as "blast holes," although the terms may be used interchangeably.

A number of factors influence the effectiveness of the blast, including the nature of the geologic structure (i.e., rock), the size and spacing of the blast holes, the burden (i.e., distance to the free face of the geologic structure), the type, amount, and placement of the explosive, as well as the order in which the blast holes are detonated. Generally speaking, the size, spacing, and depth of the blast holes represent the primary means of controlling the degree of rupture or fragmentation of the geologic structure, and considerable effort goes into developing a blast hole specification that will produce the desired result. Because the actual results of the blasting operation are highly correlated with the degree to which the actual blast holes conform to the desired blast hole specification, it is important to ensure that the actual blast holes conform as closely as possible to the desired specification.

Unfortunately, however, it has proven difficult to form or drill blast holes that truly conform to the desired specification. First, a typical blasting operation involves the formation several tens, if not hundreds, of blast holes, each of which must be drilled in proper location (i.e., to form the desired blast hole pattern) and to the proper depth. Thus, even where it is possible to achieve a relatively high hole compliance rate (i.e., the percentage of blast holes that comply with the desired specification), the large number of blast holes involved in a typical operation means that a significant number of blast holes nevertheless may fail to comply with the specification. In addition, even where blast holes are drilled that do comply with the desired specification, a number of post-drilling events, primarily cave-ins, can make a blast hole non-compliant. Indeed, such post-drilling events can be major contributors to blast hole non-compliance.

Still further, because of the large number of blast holes that are typically required for a single blasting operation, methods are constantly being sought that will allow the blast holes to be formed or drilled as rapidly as possible. As with most endeavors, however, there is an inverse relationship between speed and quality, and systems that work to increase speed at which a series of blast holes can be drilled usually come at the expense of hole quality. Consequently, there is a need for methods and systems for forming blast holes that will ensure consistent blast hole quality while minimizing the adverse effects on the speed of blast hole formation.

There is a desired ratio of penetration rate per drill bit revolution where the drill bit carbides penetrate and fracture the rock efficiently, resulting in desirable drilling speed and bit-wear characteristics. This ratio is referred to as the depth of cut (DOC). An optimum rate of penetration (ROP) for drilling efficiency can be calculated by multiplying the maximum rotation speed by the DOC. Prior art methods have used a simple feedback loop to adjust the feed force applied to the bit to maintain an assumed optimum penetration rate. (Feed force applied to the bit being generally proportional to the achieved rate of penetration.) In this application the terms "feed force" and "weight-on-bit" or "WOB" are used interchangeably.

However, at times it may be desirable to sacrifice the efficiency of the ideal depth of cut to achieve a higher penetration rate. Conversely it may be desirable to sacrifice rate of penetration to achieve longer consumable life; that is, the life of the drill bit. Also, such prior-art methods give an optimum DOC at a single penetration rate. What is needed is a method of monitoring and adjusting these opposing goals to achieve optimum drilling efficiency over a wide range of penetration rates, depending on local drilling conditions. As used in this application, the term "drilling efficiency" is not a precisely-defined term, but refers to the optimum ratio of the rate of penetration of the bit to the energy expended for extraction of a given volume of rock, taking into consideration also the amount of bit wear in such extraction.

Although this application is focused on solving problems in blast hole drilling operations, the disclosure and claims are equally applicable to the drilling of boreholes in other fields, such as oil and gas drilling.

DRAWINGS

Non-limiting embodiments of the present disclosure are described by way of example in the following drawings, which are schematic and are not intended to be drawn to scale:

DETAILED DESCRIPTION

Overview of System

Figure 1:
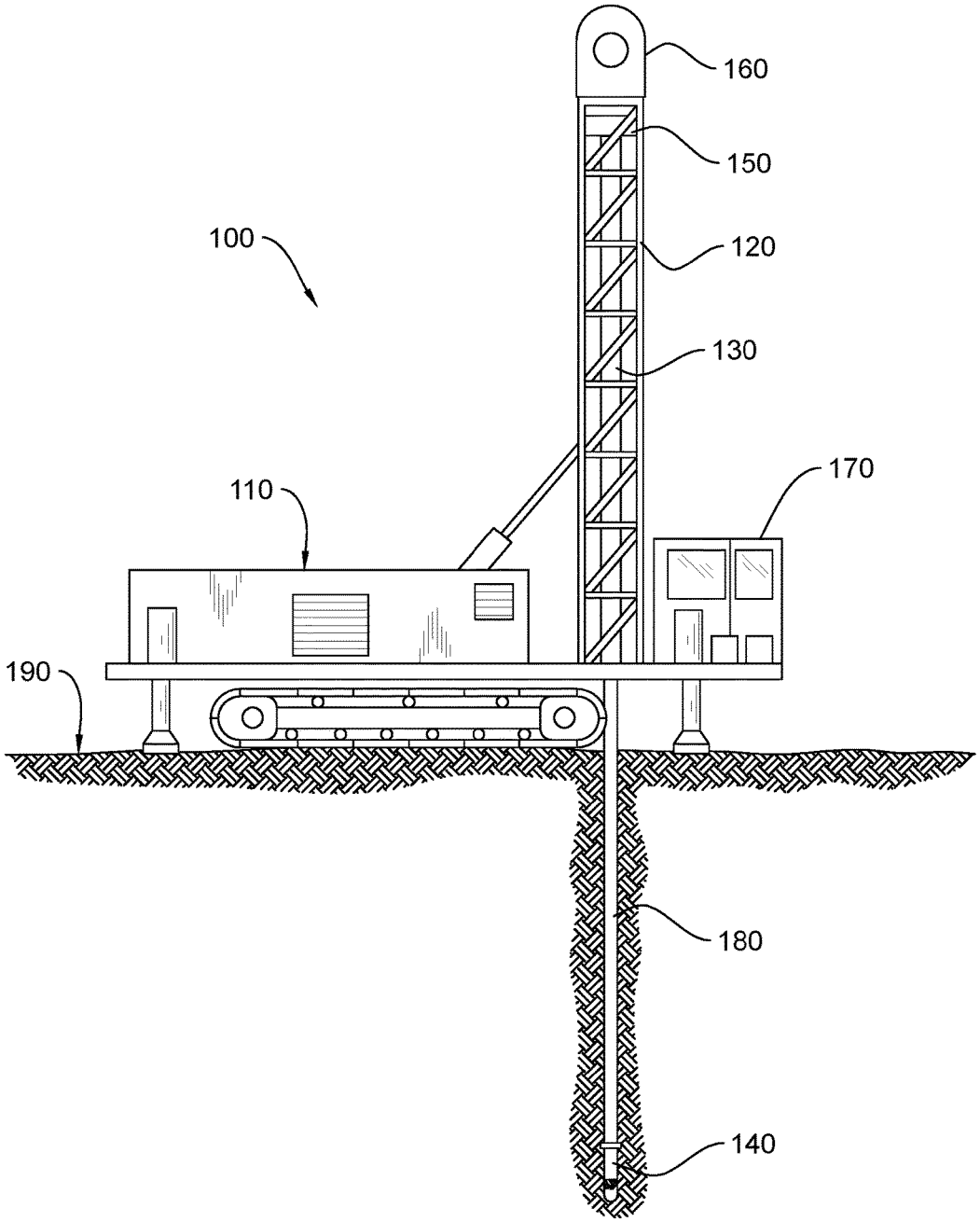
FIG. 1 depicts generally a drilling rig and control system.

Generally, the system and method of the present disclosure enhances drilling efficiency and borehole quality by monitoring one or more drilling parameters while the boreholes are being drilled. The monitored drilling parameters are compared with predetermined specifications for the parameters. If the monitored drilling parameter or parameters is outside the specification, the system selects and executes one or more procedures to adjust to ensure that drilling is carried out to the desired specification.

A graphical program or graphical model is a diagram comprising a plurality of interconnected nodes or icons, wherein the plurality of interconnected nodes or icons visually indicate functionality of the program. The interconnected nodes or icons are graphical source code for the program. Graphical function nodes may also be referred to as blocks. Exemplary graphical program development environments which may be used to create graphical programs include LabVIEW from National Instruments or Simulink from MathWorks. Many of the figures in this application are illustrations adapted from Simulink graphical models, but such figures are merely illustrative examples and do not limit the claims to any particular graphical program or depiction. The claimed methods could be implemented, for example, in C or C++ code directly. The meaning of the Simulink symbols shown in the drawings should be known to those skilled in the art, but if needed, descriptions of such symbols may be found at the Simulink web site, https://www.mathworks.com, and the links there to the relevant symbol libraries.

Referring now to FIG. 1, in one embodiment, the system 100 may comprise a drilling rig 110 having a mast or derrick 120 configured to support a drill string 130 having a drill bit 140 provided on the end thereof. Drilling rig 110 may also be provided with various systems for operating the drill string 130 to form boreholes 180. For example, in the embodiments shown and described here, drilling rig 110 may also comprise a drill motor system 150, a drill hoist system 160, as well as an air injection system and a water injection system (not shown in FIG. 1). The term "hoist system" as used here refers to any system or actuator for raising and lowering the drill string, which may include a conventional pulley and sheave hoist system or actuator motors.

The system 100 comprises a control system 170 that is operatively associated with the drilling rig 110, as well as with the various systems thereof, e.g., a motor system 150, a hoist system 160, or an air injection system and water injection system (not shown in FIG. 1). As will be explained in greater detail below, control system 170 monitors various drilling parameters generated or produced by the various drill systems and controls them as necessary to form the borehole 180 into the surface of the formation 190.

The drill motor system 150 is connected to the drill string 130 and may be operated by a control system 170 to provide a rotational force or torque to rotate the drill bit 140 provided on the end of the drill string 130. The control system 170 may operate the drill motor system 150 so that the drill bit 140 rotates in either the clockwise or counterclockwise directions. The drill motor system 150 may also be provided with various sensors and transducers (not shown in FIG. 1) to allow the control system 170 to monitor or sense the torque applied to the drill bit 140, as well as the rotational speed and direction of rotation of the drill bit 140.

The drill hoist system 160 is also connected to the drill string 130 and may be operated by control system 170 to raise and lower drill bit 140. As was the case for the drill motor system 150, the drill hoist system 160 may also be conventionally provided with various sensors and transducers (not shown) to allow the control system 170 to monitor or sense the hoisting forces applied to the drill string 130, and thus the weight-on-bit (WOB), as well as the vertical position or depth of the drill bit 140.

Figure 2:
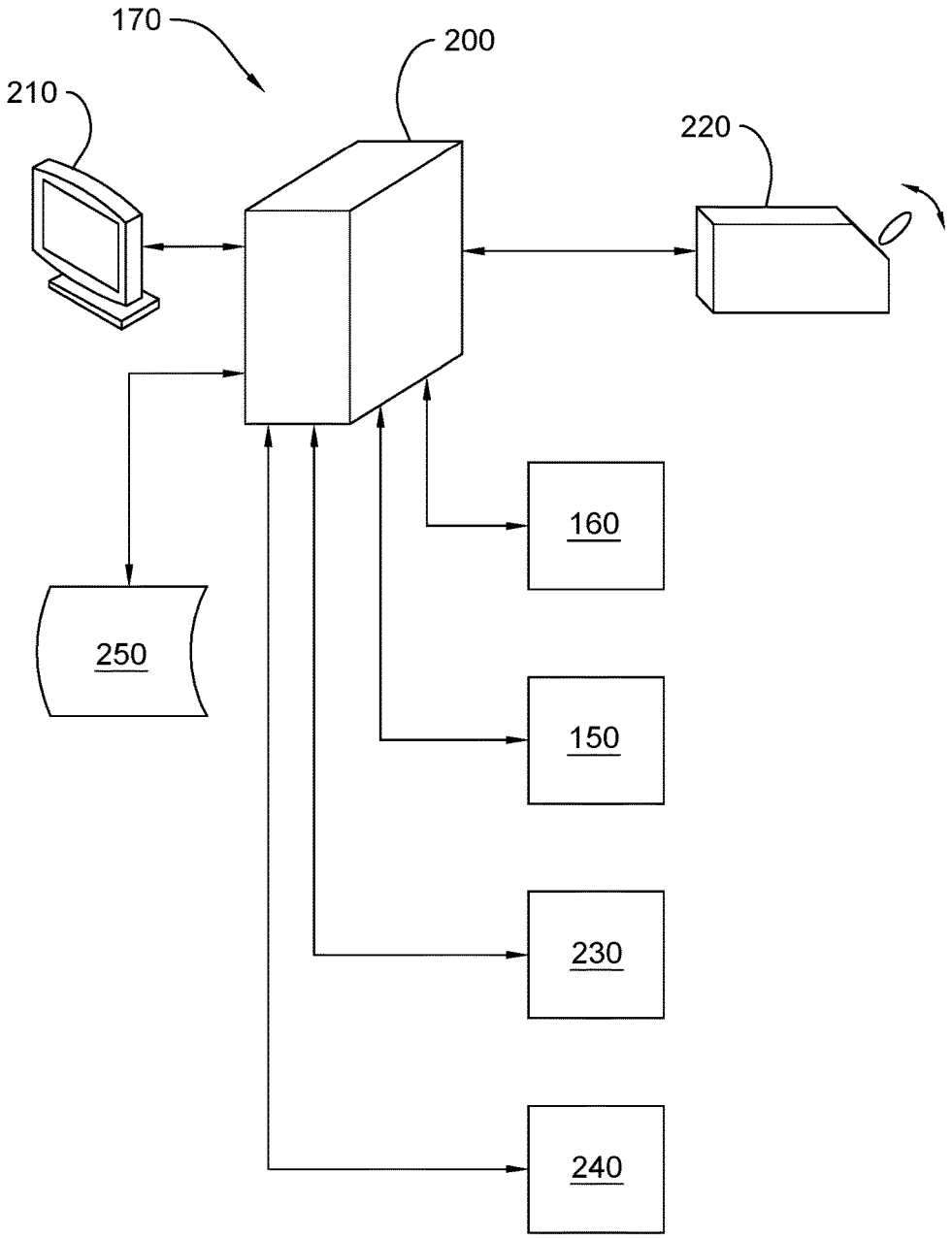
FIG. 2 depicts schematically functions comprising the control system of an embodiment.

FIG. 2 schematically shows the control system 170 referred to above at a high level. FIG. 2 is not limiting, and the control system 170 may comprise other and further components relevant to its function. The control system 170 includes a computer 200 that is typically a programmable digital computer comprising a read-only memory, a non-transitory computer readable storage medium for storing instructions executable by a processor (such as a random-access memory), a central-processing unit or processor, and a hard drive or flash memory or the like for further storage of programs and data, as well as input and output ports.

In FIG. 2, the drill hoist system 160 and the drill motor system 150 are shown schematically as operatively connected to the computer 200 of the control system. Also present in practical drilling systems, and also operatively connected to the computer 200, may be an air-injection system 230 and a water-injection system 240, which systems may also include various sensors and transducers to allow the control system 170 to monitor or sense the amounts or flows of injected fluids.

The control system 170 also may include a display 210 with a graphical user interface, and an operator's control console 220, connected to the computer 200 to receive inputs from an operator during a drilling operation, and provide information to the operator. The operator's console 220 may include a keyboard, keypad, joystick, mouse, or other input device. In this application, the collective input mechanisms of the operator's console 220 and the display 210 may be referred to generally as a graphical user interface, or GUI. The display 210 of the GUI may of course provide one or more pages of information and input fields to an operator. The operator console 220 may not necessarily be located on the drilling rig 110, but may be remotely connected to the control system.

As further discussed below, the computer 200 of control system 170 is operatively connected to a database 250 of predetermined drilling parameters.

In the drilling system 100 and methods claimed here, a database 250 is provided having predetermined settings and parameters for achieving optimum performance of the drilling system 100. Such settings and parameters can include drill-bit class codes provided by the International Association of Drilling Contractors (IADC), as well as physical characteristics, such as drill bit diameter and cutting-tooth height. In the operation of one embodiment of the drilling system 100, an operator chooses the IADC code of the bit being used from a dropdown menu on the operating system GUI of the control console 220. The drill bit data and drill pipe diameter values are similarly entered. From these inputs, calculations are performed as described below, and the optimum operating range for the bit chosen is used for automatic control of drilling, and also displayed as a reference for manual drilling.

Further, in one embodiment, a maximum rotation speed for the drill bit 140 is stored the database 250 for each IADC code, and also a minimum rotation speed for all bit types. The desired operating window for the range of rotation speed is displayed on the GUI and used by the control system 170 for automatic control, as further explained.

A maximum rotation torque value per unit drill bit diameter is also stored within the database 250. A maximum drilling torque is calculated by multiplying this value by the entered drill bit diameter, as explained more fully below. The maximum drilling torque may also be calculated as a percentage of the torque capability of the drilling rig 110 to prevent rotation stall. The lesser value of the bit maximum drilling torque or rig maximum drilling torque is used. This value is displayed on the GUI and used as the point where the control system 170 will begin to reduce feed force to regulate torque. In some embodiments a recommended bit air pressure range is stored in the database 250 and displayed on the GUI based on good drilling practice for rotary bits.

An ideal depth-of-cut (DOC) for each IADC code and a maximum feed rate for that depth of cut is then calculated as explained below. The cutting-tooth height for a range of drill bit sizes and IADC codes is provided in the database 250, and this data is extrapolated to estimate the cutting-tooth height for any size rotary drill bit of each IADC code (typically, cutting-tooth height is not published by bit manufacturers, but must be measured). When an operator chooses the IADC code and bit size in the GUI, the ideal depth of cut is calculated as a fraction of estimated cutting tooth height. It has been found preferable to set the ideal depth of cut to approximately 66% of the estimated cutting tooth height.

This ideal DOC may then be used in the calculation for commanded rotation speed by the control system 170. This ideal DOC is also used in the calculation for feed force command used by the control system 170. This ideal DOC is further used in the calculation for maximum feed rate command of the control system 170, in which case the maximum feed rate is displayed on the GUI. The maximum feed rate is set by multiplying the ideal DOC by the maximum rotation speed and a predetermined factor, for example 400%. We have found the latter factor to be a reasonable for a wide variety of drill bit types. The maximum feed rate is relevant to the control system 170 when operating in voids or very soft ground, where feed force control is no longer an effective means of controlling feed rate. For example, if the feed rate of drilling is too fast because of very soft formations, cuttings will not be removed from the borehole fast enough.

Further, in one embodiment, a weight-on-bit (WOB) maximum value for a given unit drill bit diameter is stored within the database 250 for each IADC code. The operating maximum WOB is then calculated by multiplying this maximum value stored in the database 250 by the diameter of the chosen bit. A weight-on-bit minimum is calculated by multiplying the operating maximum by some fraction, for example 33%. The desired operating WOB range is displayed on the GUI and used by the control system 170 for automatic control, as further explained below.

The model of FIG. 7, explained in more detail below, illustrates the steps of the control system 170 carried out to calculate and command a possibly varying weight-on-bit. The feed force is regulated by the motors in the hoist system 160. In one embodiment, the control system 170 applies feedback control to command feed force in inverse proportion to the DOC. A maximum feed force boundary is set based on bit size and type to prevent overloading the bit and causing premature damage. A minimum feed force boundary is set as a proportion of the maximum; preferably the minimum is set to 33% of the maximum. The minimum is set to keep the bit firmly engaged to the rock, to prevent unwanted vibration which would also cause premature damage.

In this application, "aggressiveness" refers to a consumable-life vs. rate-of-penetration scale, preferably chosen by the operator in the GUI. The "consumable" would generally be the drill bit, drill pipe, fuel for running the drilling rig 110 and water used in the drilling process. The aggressiveness may be adjusted by the user to balance the cost of drilling time against the cost of drill bits. The aggressiveness is scaled from 0-10 with 0 being the least aggressive and 10 being the most aggressive.

The system will target the maximum feed force between penetration rates of zero and a percentage of optimum penetration rate. The optimum penetration rate is the fastest we can drill at maximum drilling efficiency. At the most aggressive setting, the percentage of optimum penetration rate is set at about 125%. The system will target minimum feed force when the penetration rate exceeds another percentage of optimum penetration rate; at the most aggressive setting, this percentage of optimum penetration rate is set at about 300%. The feed force target decreases linearly from maximum at about 125% of optimum feed rate to minimum at about 300% of optimum feed rate. These values for the most aggressive setting provide maximum rate of penetration while exception controllers (described below) prevent undue waste of consumables or damage to the drilling rig 110.

As described in more detail below, the feed force, minimum air pressure and bailing velocity values are directly adjusted by the aggressiveness setting. (Bailing velocity is the velocity of the flushing traveling from the cutting surface to the top of the borehole.) The maximum feed force is reduced at lower aggressiveness settings, typically to a minimum of about 50% at the lowest aggressiveness setting. The percentage of optimum penetration rate also decreases at less aggressive settings down to a minimum of about zero.

Regarding control of air pressure, the minimum air pressure target increases linearly with increased aggressiveness. The bailing velocity target increases linearly with aggressiveness. Generation of airflow is large consumer of power in the drilling process therefore operating at lower airflow at less aggressive settings will reduce fuel burn. Reduced airflow will also decrease abrasion wear on drill pipe. In addition, at lower aggressiveness settings, the operating rotation speed, and water flow rates will generally be reduced, because in this system the targets for these are proportional to feed rate. In addition to the user selecting an aggressiveness setting, the system may adjust the aggressiveness setting automatically. Each time drilling parameters exceed a jam value, the aggressiveness is reduced by one increment. After a distance or time without exceeding a jam value, the aggressiveness automatically increases back to the operator setpoint.

A feedback loop compares the actual feed force as measured by sensors and monitors the calculated target feed force. If error is present, the controller increases or decreases the weight-on-bit actuator output to reduce the error and meet the calculated target weight-on-bit.

Water is used in the blast hole drilling process for dust suppression and hole stabilization. Water is injected into the drill string and flows with flushing air out of the bit where it mixes with cuttings from the drilling process. Water can have a negative effect on drilling bit life and can slow drilling penetration rate. It is desired to use the minimum amount of water necessary to achieve the dust suppression and hole stabilization goals.

As described below, this control of the amount of water injected by the control system 170 is performed with a water flow strategy that injects water in proportion to the amount of material being removed in the drilling process. The amount of material being removed is calculated by multiplying the borehole area by the current rate of penetration, or, (Pi/4)*Dbit^2*R, where Dbit is the bit diameter, and R is the rate of penetration. For normal drilling a low proportion of water to cuttings is used, for example the volume of water would preferably be equal to about 5% of the volume of cuttings. Less water will be used as drilling slows and more water will be used as drilling speed and the amount of cuttings increases, so dust can be suppressed with a minimum amount of water.

In one embodiment, the control system 170 commands an output from the water injection system 240 to achieve the calculated water-flow target. If there is no water-flow sensor present, the commanded water flow is in proportion to the maximum output of the water-injection system 240. If a water-flow sensor is present, a feedback loop is used to measure error between commanded and actual water flow output and adjustments are made to reduce the error.

In unstable ground it can be beneficial to use increased water so cuttings will clump together and fill voids. The start of a blast hole is generally drilled through ground that has been fractured by the previous blast of the material above it, and the ground is therefore less stable. The control system 170 is programmed to use the same proportional strategy as just described, but with an increased ratio of water, for example, about 15%, to stabilize the ground while in hole collaring mode (i.e. starting the hole).

It is further desirable to stabilize the blast hole and cuttings pile generated while drilling so the borehole 180 will remain intact and drill depth remain accurate until the borehole 180 is loaded with explosives. To achieve this, the control system 170 again uses the same proportional strategy, but a uses much higher ratio of water, for example, about 50%, while near the bottom of the hole, for example, within one meter of target depth. This water mixes with the cuttings and forms a layer of mud in the borehole 180 and over the top of the cuttings pile. As this mud layer dries, it forms a hard stable cap to the borehole 180. As shown below, the control system 170 automatically switches between the three described water flow targets based on the vertical position of the drill bit 140 in the borehole 180.

Figure 13A:
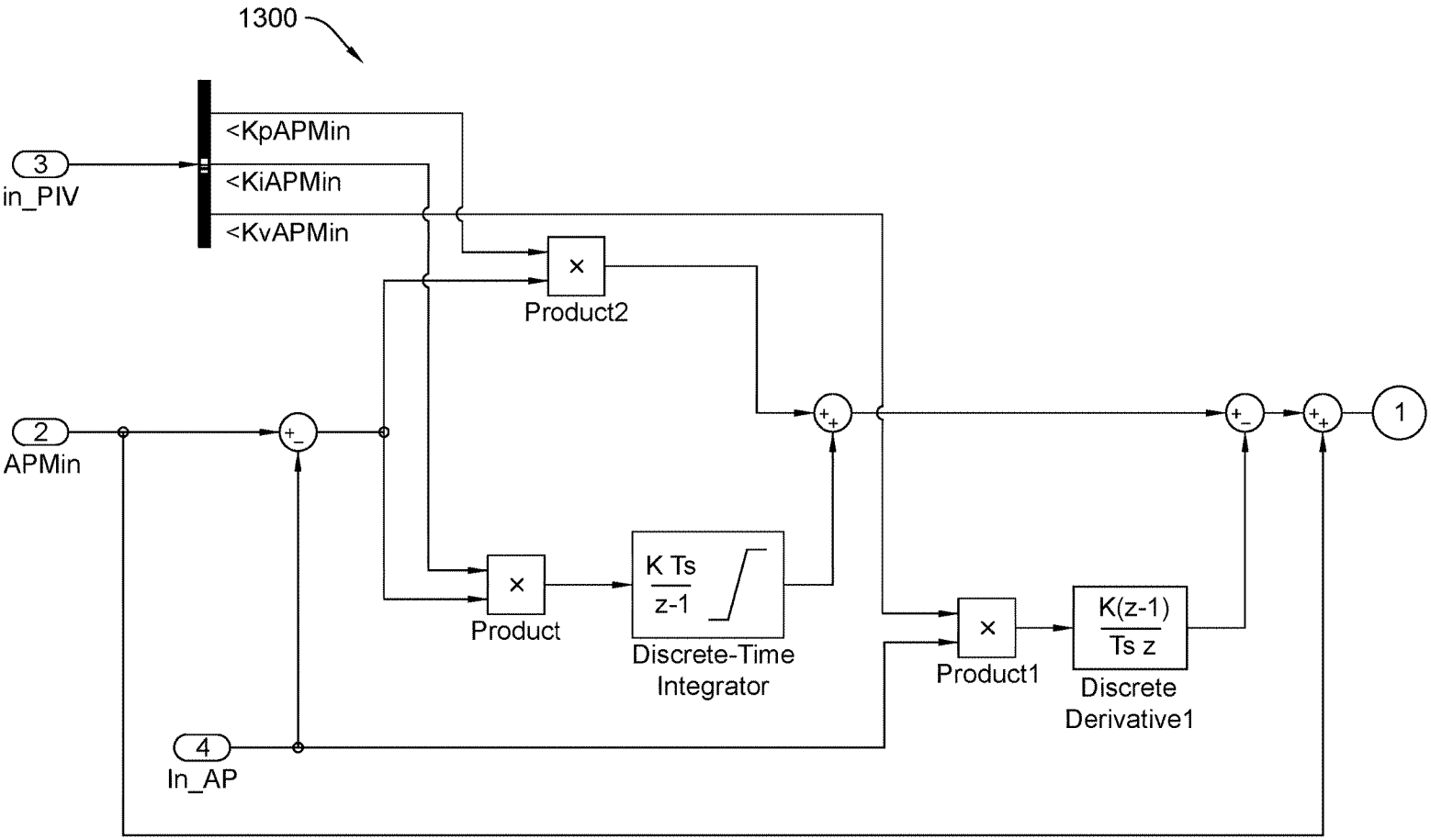
FIGS. 13A and 13B are partial views of the same graphical model showing exemplary procedures for the control of air injection.
Figure 13B:
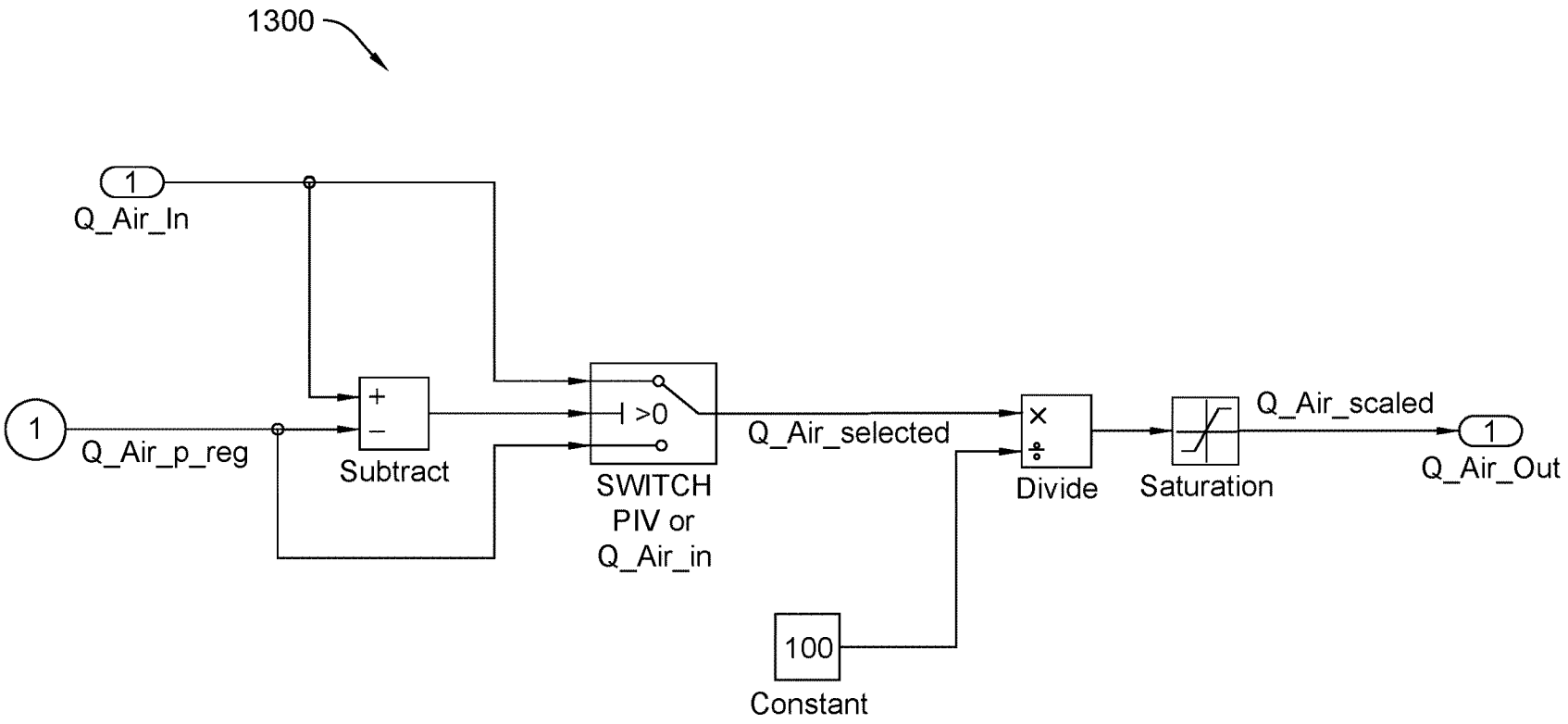

Control of compressed air flow control is illustrated in FIG. 13 below and the accompanying discussion

Description of Embodiments

Figure 3A:
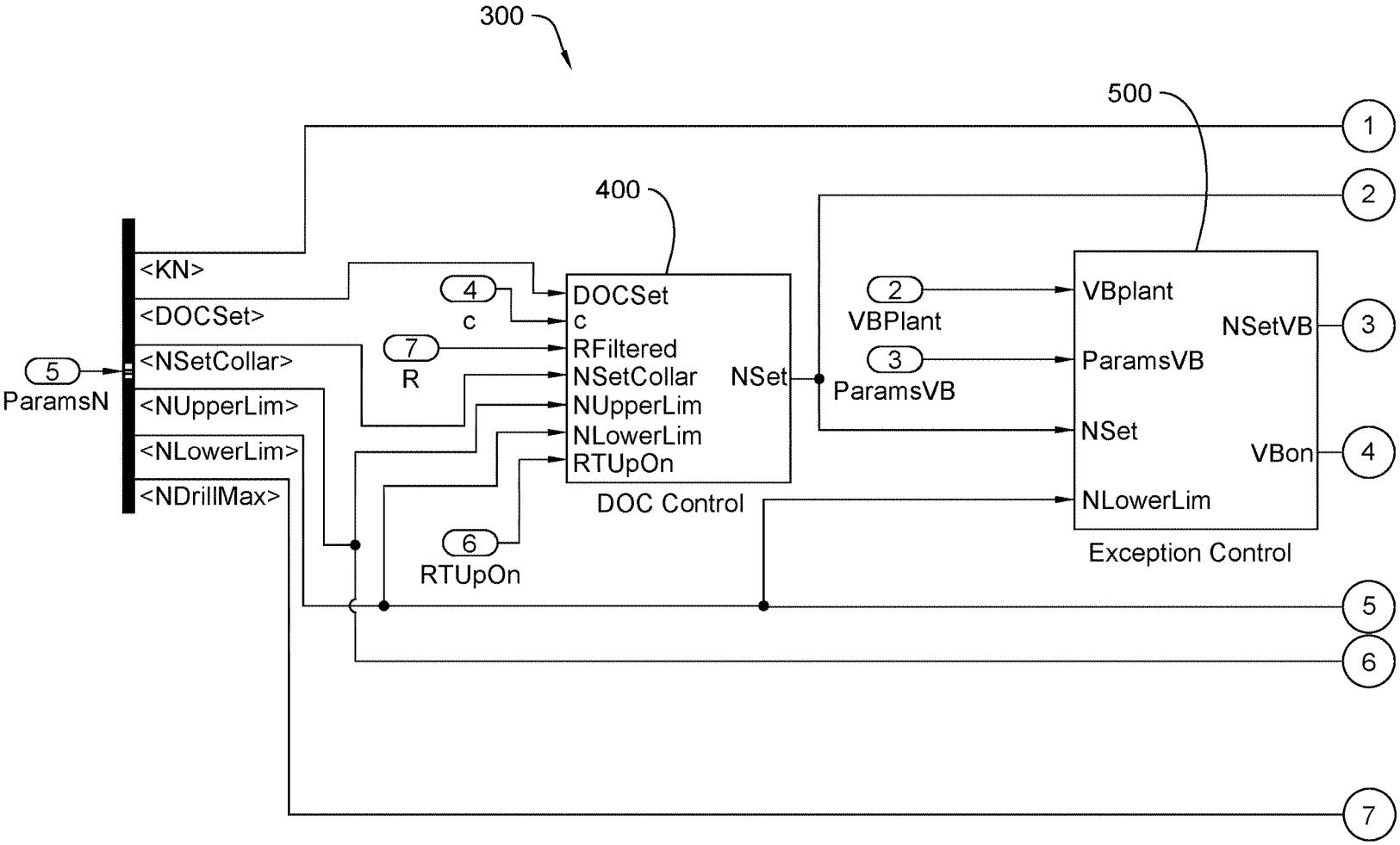
FIGS. 3A and 3B are partial views of the same graphical model showing exemplary procedures for the control of drill rotation speed.
Figure 3B:
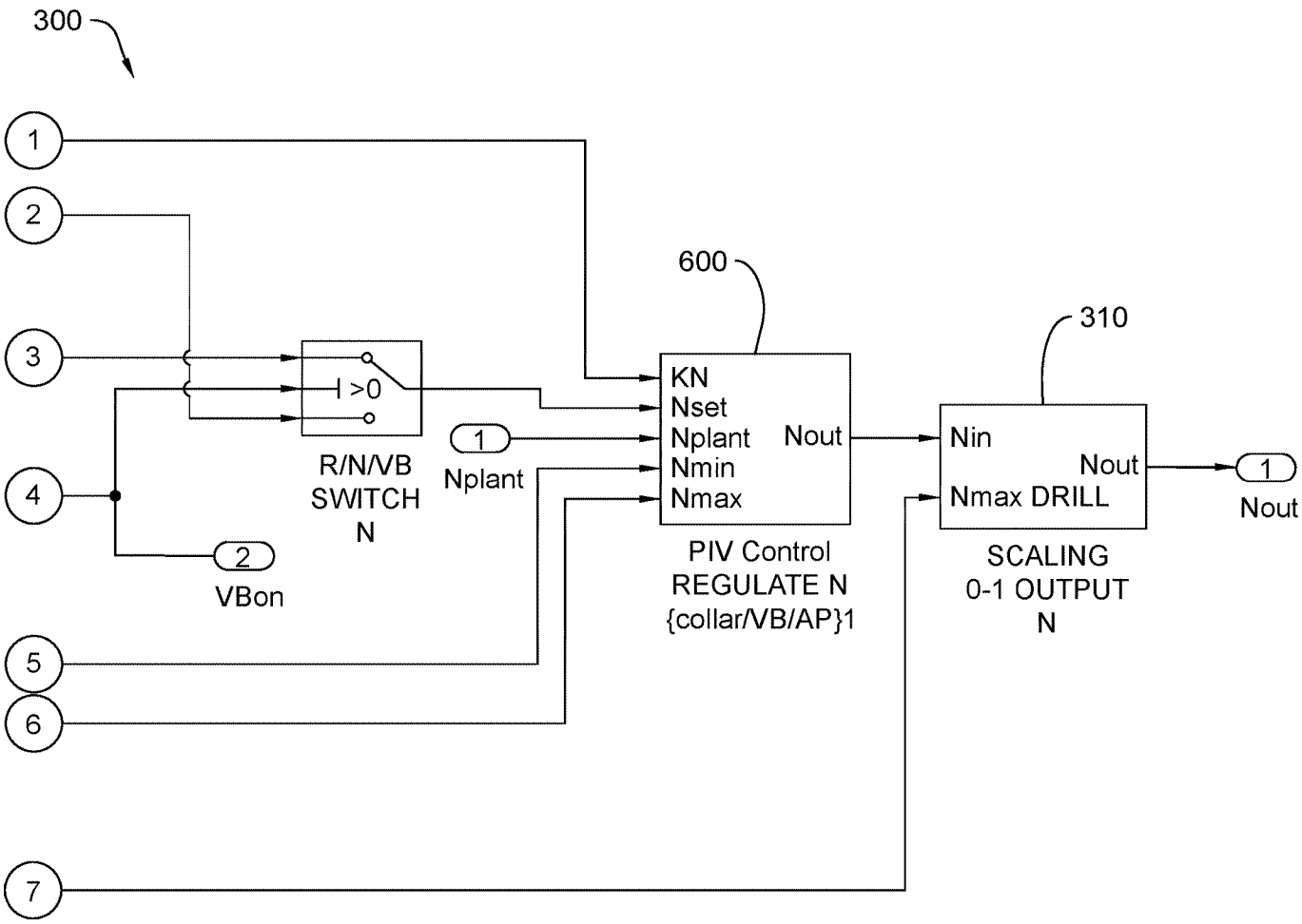

FIG. 3 is a graphical model 300 showing exemplary procedures for the control of the rotation speed of the drill bit 140 through regulation of the drill motor 150. As stated above, the Simulink modeling language is used in this and other figures to disclose the claimed methods, but the methods are not dependent on, nor do they require, the use of Simulink modeling or any particular modeling language.

Table 1 following lists definitions for the various identifiers shown in the graphical models shown in FIGS. 3, 4, 5, and 6, relevant to the procedures for control of rotation speed. (In the identifiers used in this disclosure, the word "plant" refers generally to a value from a sensor on the drilling rig 110, as opposed to a target value or input parameter.)

TABLE 1

| Name | Source | Description |
|---|---|---|
| c | Calculated | AutoDrill is operating in collaring mode at start of hole |
| DOCSet | Calculation | Depth of cut (penetration per revolution) value in m/revolution typically set to ⅔ the height of the cutting teeth on the bit |
| K | Parameter | Gain values for rotation speed feedback loop |
| Ki | Parameter | Integral gain |
| KiN | Parameter | Integral gain for rotation speed feedback loop |
| KN | Parameter | Gain values for rotation speed feedback loop |
| Kp | Parameter | Proportional gain |
| KpN | Parameter | Proportional gain for rotation speed feedback loop |
| Kv | Parameter | Derivative gain |
| KvN | Parameter | Derivative gain for rotation speed feedback loop |
| Max | Parameter | Value at which jam escape will activate tor retract the bit, used to scale error |
| Min | Calculation | Minimum setpoint of parameter exception controller will directly adjust to prevent jam condition |
| NDrillMax | Parameter | Maximum rotation speed (RPM) that rig is capable of |
| Nin | Calculation | Rotation speed target after feedback loop adjustment |
| NLowerLim | Calculation | Minimum rotation speed (RPM) based on rig torque capability to maintain stable rotation |
| NLowerLim | Calculation | Minimum rotation speed (RPM) based on rig torque capability to maintain stable rotation |
| Nout | Output | Rotation speed target after scaling, range from 0 to 100% (max rig rotation speed) |
| Nplant | sensor | Current measured rotation speed from rig (RPM) |
| NSet | Output | Rotation speed target in (RPM) based on DOC, collaring, or retraction antijam |

TABLE 1-continued

| Name | Source | Description |
|---|---|---|
| NSetCollaR | Calculation | Rotation speed setting to be used while collaring, (RPM), typically set at 120% of minimum rotation speed |
| NUpperLim | Calculation | Maximum rotation speed (RPM) based on rig capability or bit manufacturers recommendation. |
| On | Output | Indication that exception controller is reducing parameter setpoint to prevent jam condition |
| Plant | sensor | Current value of parameter exception controller is indirectly attempting to modify |
| Rfiltered | sensor | Current measured feed rate from rig (m/min) |
| RTUpOn | Calculated | identifies when retraction torque control feed rate should be used to reduce feed up rate |
| Set | Calculation | Current setpoint of parameter exception controller will directly adjust to prevent jam condition |
| SetOut | Output | Adjusted output of parameter being directly adjusted to prevent jam condition |
| Target | Parameter | Value which exception controller attempts achieve |

Rotation speed control model 300 receives the parameters as input shown in FIG. 3. DOC control model 400 outputs a rotation speed target based on either the depth of cut, collaring setting, or retraction anti jam setting. DOC control model 400 is further explained with respect to FIG. 4. The exception control model 500 receives the rotation speed target setting from the DOC control model 400, and uses feedback control to reduce the rotation speed target setting when a threshold is crossed, to provide for jam prevention. The outputs of the exception control model 500 are the parameters Vbon and NsetVB. The exception control model 500 is further explained in detail with respect to FIG. 5.

Figure 7A:
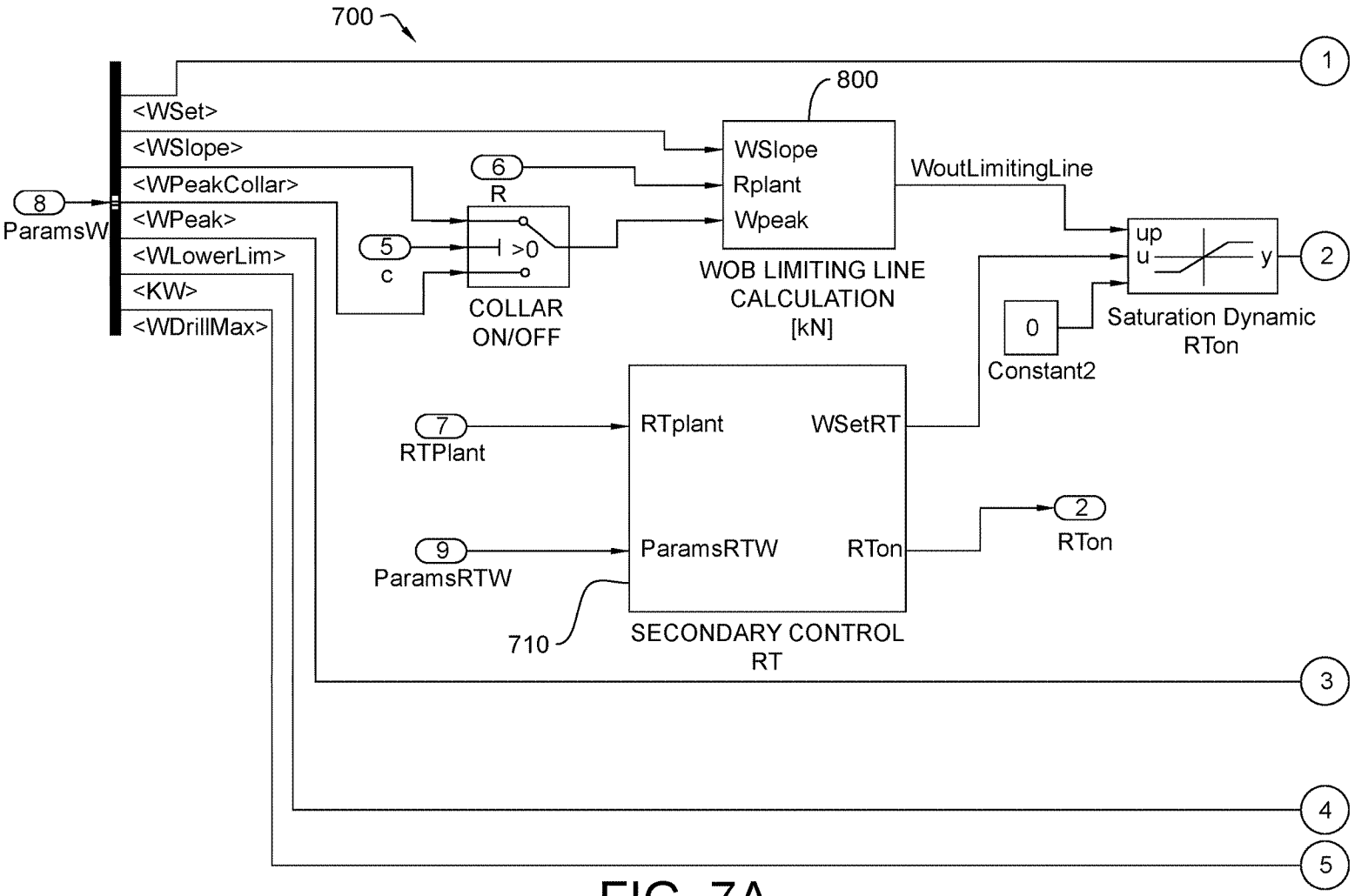
FIGS. 7A and 7B are partial views of the same graphical model showing exemplary procedures for the weight-on-bit limiting calculation.
Figure 7B:
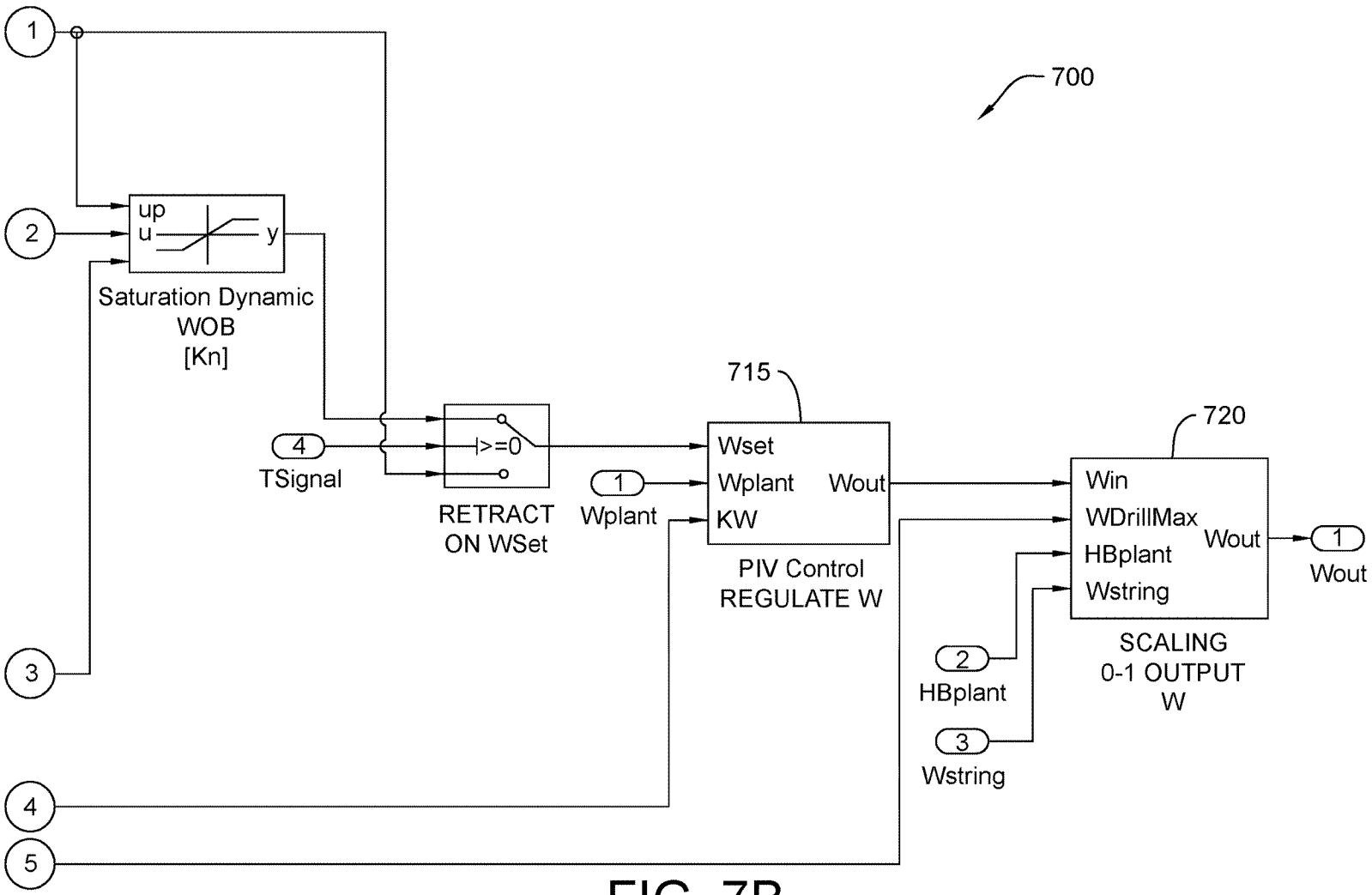
Figure 9A:
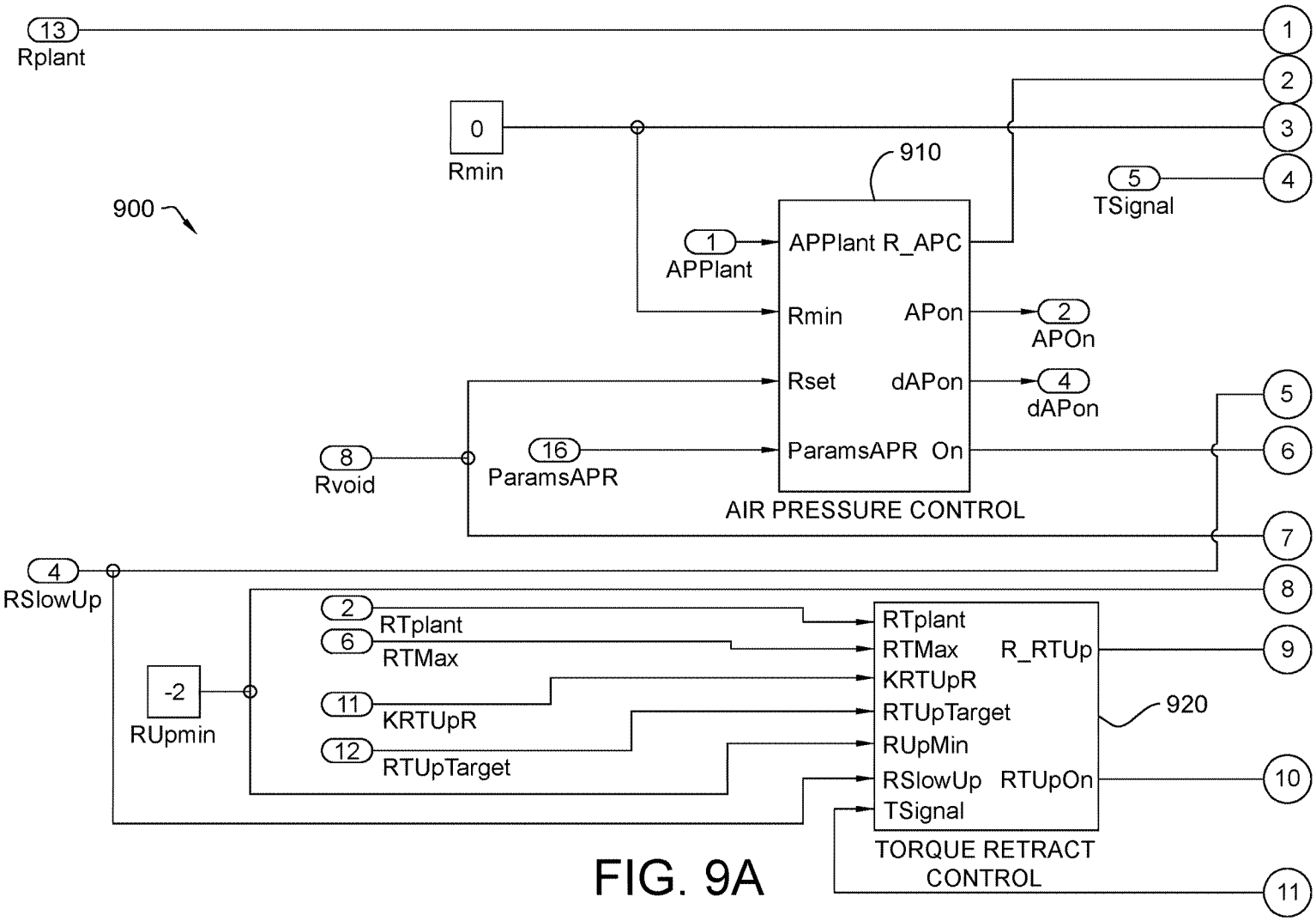
FIGS. 9A and 9B are partial views of the same graphical model showing exemplary procedures for a feed rate controller.
Figure 9B:
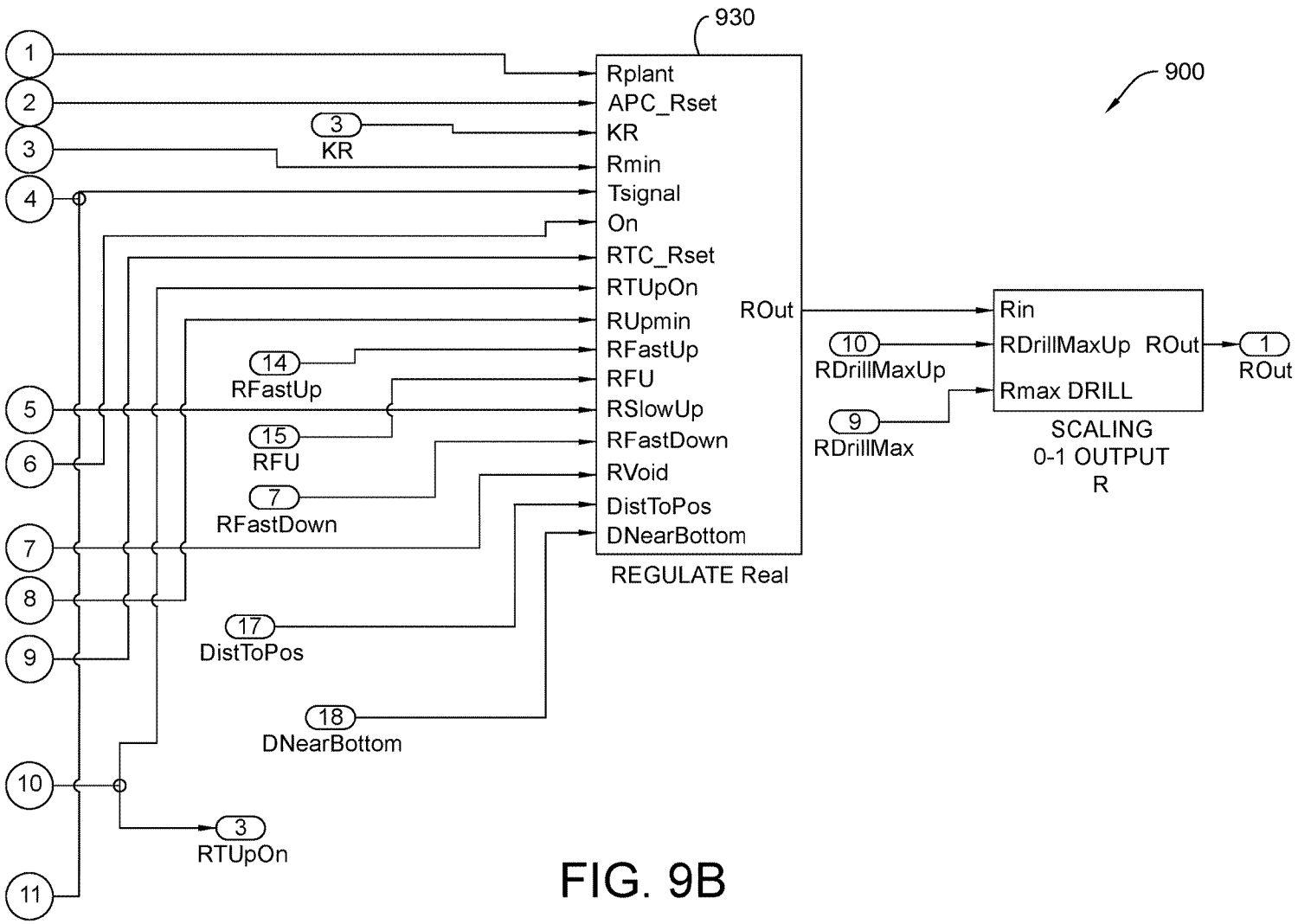

The reader should note that the exception control model is generic to other functions in this disclosure, and also appears with differently-named input parameters in FIGS. 7 and 9. The following table relates the class of exception-controller variable names to the corresponding variable names in the various applications of the exception controller model.

TABLE 1A

| Variable Class | Rotation Speed | Feed Rate down AP | Feed Rate up Torque | Feed Force |
|---|---|---|---|---|
| K | KVB | KAPR | KRTUpR | KRTW |
| Kp | KpVB | KpAPR | KpRTUpR | KpRTW |
| Ki | KiVB | KiAPR | KiRTUpR | KiRTW |
| Kv | KvVB | KvAPR | KvRTUpR | KvRTW |
| Max | VBMax | APMax | RTMax | RTMax |
| Target | VBTarget | APTarget | RTUpTarget | RTTarget |
| Plant | Vbplant | APPlant | RTPlant | RTPlant |
| Set | Nset | Rset | RSlowUp | Wset |
| Min | NLowerLim | Rmin | RUpMin | WLowerLim |
| SetOut | NSetVB | R_APC | R_RTUp | WSetRT |
| On | Vbon | APOn/dAPOn | RTUpOn | Rton |

In the rotation speed control model 300, if the jam prevention control is active, as set by parameter VBon, then the value from the exception controller will be used instead of the normal output target rotation speed. FIG. 3 further shows a PIV control model 600. PID control, using proportional, integral, and derivative gain, is a common method of servo tuning and is well-suited for applications that can be modeled as a linear function that does not vary with time. PIV control goes one step further and places a velocity feedback loop inside the position feedback loop. This additional feedback loop makes PIV control better at regulating velocity than PID control is. The PIV control model 600, or other proportional model chosen, adjusts the rotation speed output to that the plant value matches the target rotation speed output by the DOC control model 400. The PIV control model 600 of the present disclosure is further explained with respect to FIG. 6. In this disclosure, unless otherwise stated, either PIV or PID control functions or other similar control functions may be implemented.

The output value of the PIV control model 600 shown in FIG. 3 is scaled by dividing the adjusted output value by the maximum output value of the drilling rig 110, and the result limited to values between 0 and 1 in block 310. This resulting value is then output as a percentage command to the rotation actuator, in this case, the drill motor 150.

Figure 4A:
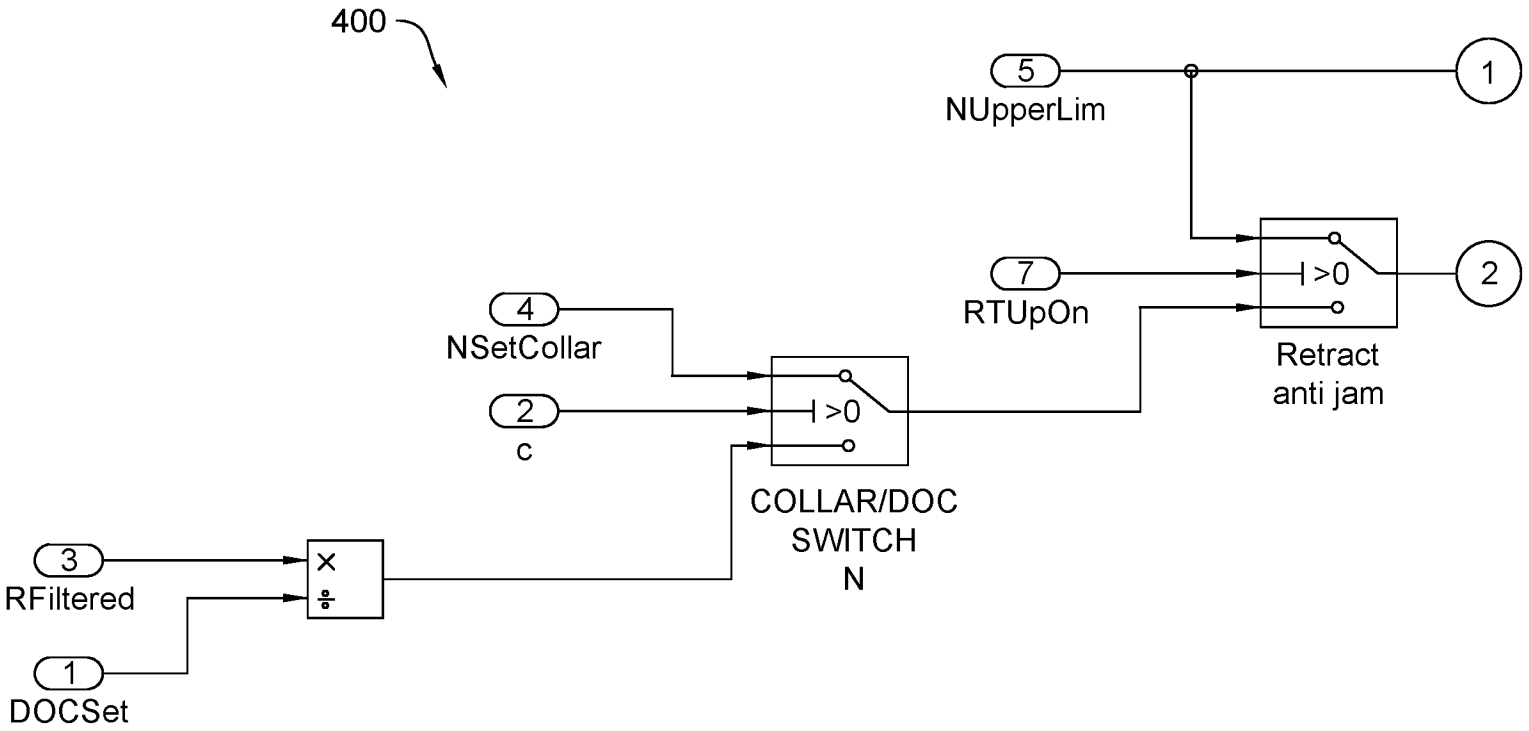
FIGS. 4A and 4B are partial views of the same graphical model showing exemplary procedures for the control of depth-of-cut.
Figure 4B:
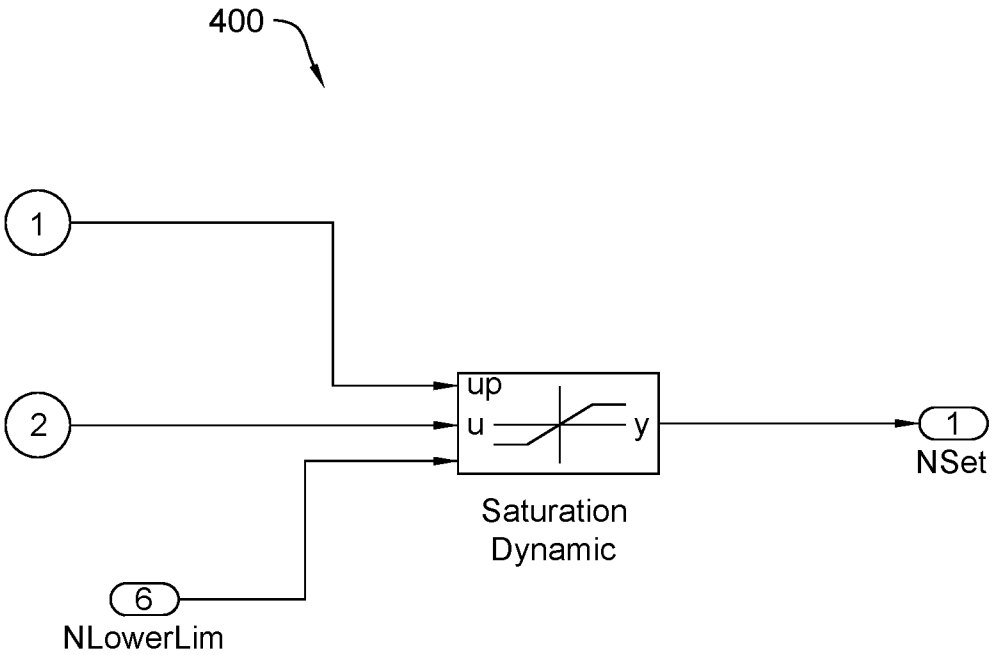

FIG. 4 illustrates the DOC control model 400 referenced by the rotation speed model 300 described above. The DOC control model receives as input the Rfiltered parameter and the DOCSet parameter. The current penetration rate Rfiltered is divided by the desired depth of cut to calculate the desired rotation speed for the current feed rate. That is, revolutions/minute=(penetration/minute)/(penetration/revolution). If the collaring mode is active (parameter c>0) then the fixed collaring rotation speed target is used instead of the depth-of-cut based rotation speed target. If retraction anti jam mode is active (parameter RTUpOn>0), then the maximum rotation speed is used to prevent stalling while back reaming, instead of either the collaring or the depth-of-cut rotation speed target.

Continuing with FIG. 4, the target rotation speed to be output is restricted to between the maximum allowed rotation speed and the minimum rotation speed in the illustrated saturation dynamic block. The maximum value is the lesser of the capabilities of the drilling rig 110, or the drill bit manufacturer's recommendations. The minimum value is preferably chosen to maintain stable rotation.

Figure 5A:
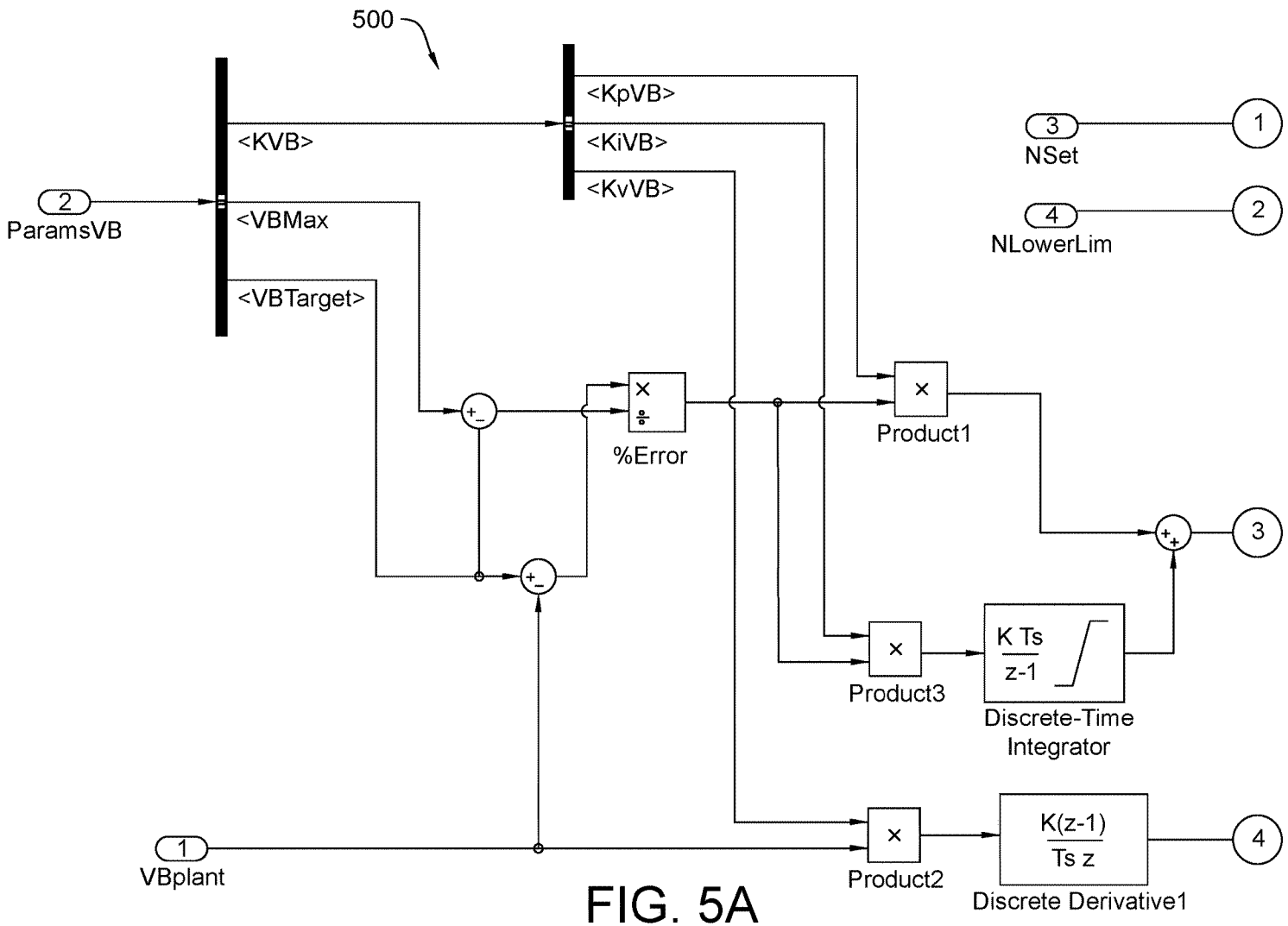
FIGS. 5A and 5B are partial views of the same graphical model showing exemplary procedures for an exception controller.
Figure 5B:
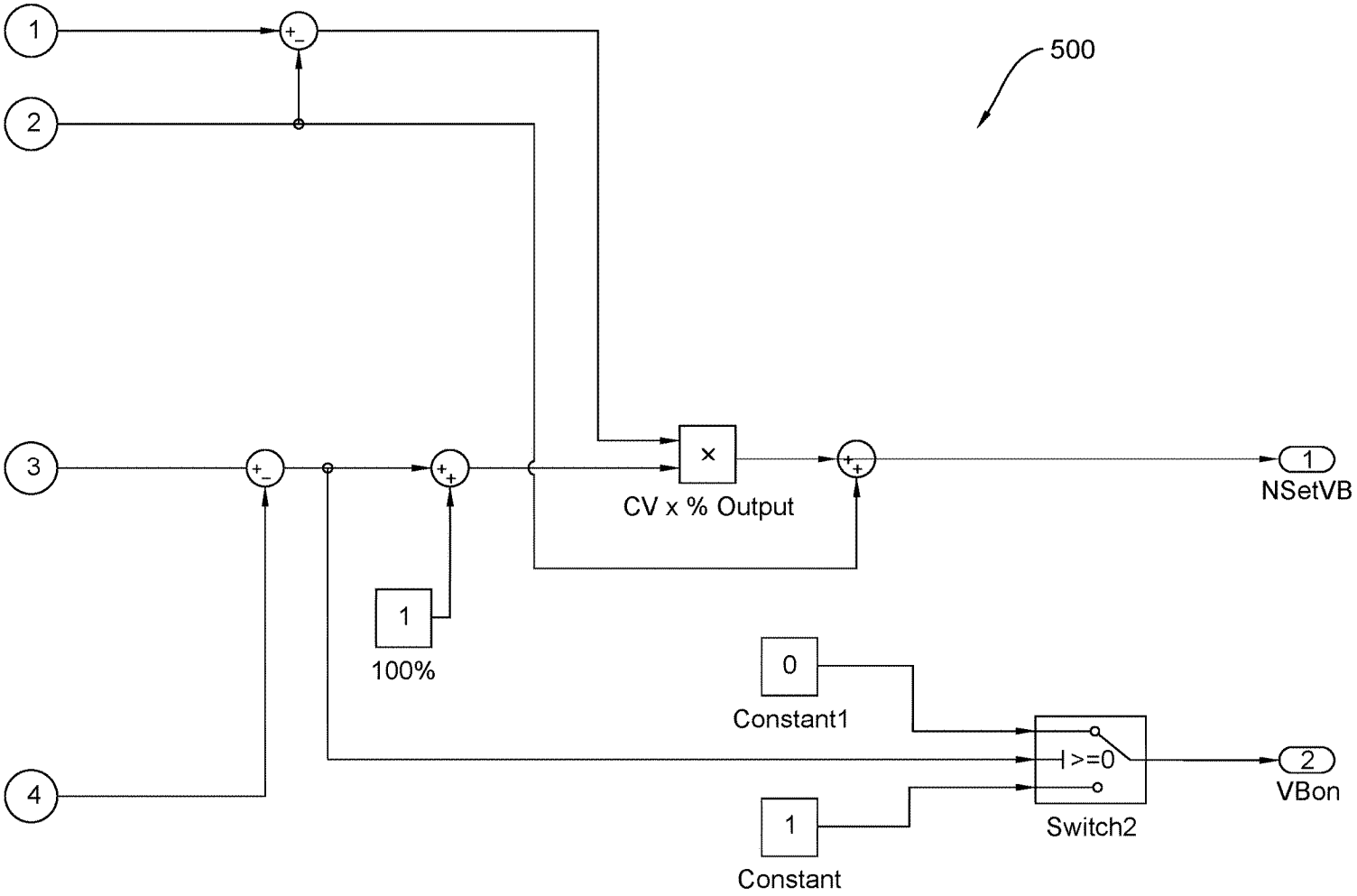

FIG. 5 illustrates the exception control model 500 referenced by the rotation speed model 300 described above. This model uses feedback control to reduce the target setting when a threshold is crossed, to provide for jam prevention. Inputs are scaled to jam prevention variable range and outputs are scaled to the control variable range.

A threshold for jam prevention is preferably monitored by detecting lateral vibration of the drilling rig 110, which vibration can be measured with a sensor, such as an accelerometer, mounted to the drilling rig 110 support structure. Optionally, the sensor would output the vibration as a root-mean-squared G-force.

Exception control model 500 receives as input parameters KpVB, KiVB, KvVB, VBMax, and VBTarget, and also sensor value VBplant, representing the vibration magnitude. The VBTarget value is the setting where jam prevention begins. The VBMax value is the setting where retraction is started to escape a jam. The target is subtracted from the maximum, and the resulting value is used to scale the controller response. The VBplant value is subtracted from the VBTarget value. If the VBplant value is higher than VBTarget, the result will be negative. The resulting error value is divided by the range between max and target to calculate a scaled error.

The scaled error value is multiplied by a proportional gain, and also multiplied by an integral gain, which latter result is then integrated over time. The sensor value Vbplant is multiplied by a derivative gain, and the derivative of the sensor value is taken. Proportional and integral values are added and derivative value is subtracted from the target value to create an adjustment value.

Further, with regard to FIG. 5, the lower limit for the variable being controlled (NlowerLim) is subtracted from the current setpoint (Nset) of the value being controlled to scale the range of the response. See inputs to exception control block 500 in FIG. 3. The value 1 is added to the adjustment factor, representing 100%. If the adjustment value is negative due to a plant value being larger than the target value, this will result in an output target less than 100%. The range for the variable being controlled is multiplied by the adjustment percentage and then added to the lower limit for the variable (parameter output NsetVB). If the adjustment value is positive this indicates alternative control will not be active; if the adjustment value is negative, then this indicates that alternative jam prevention control is active and an indication is given to the operator (parameter output VBon)

Figure 6A:
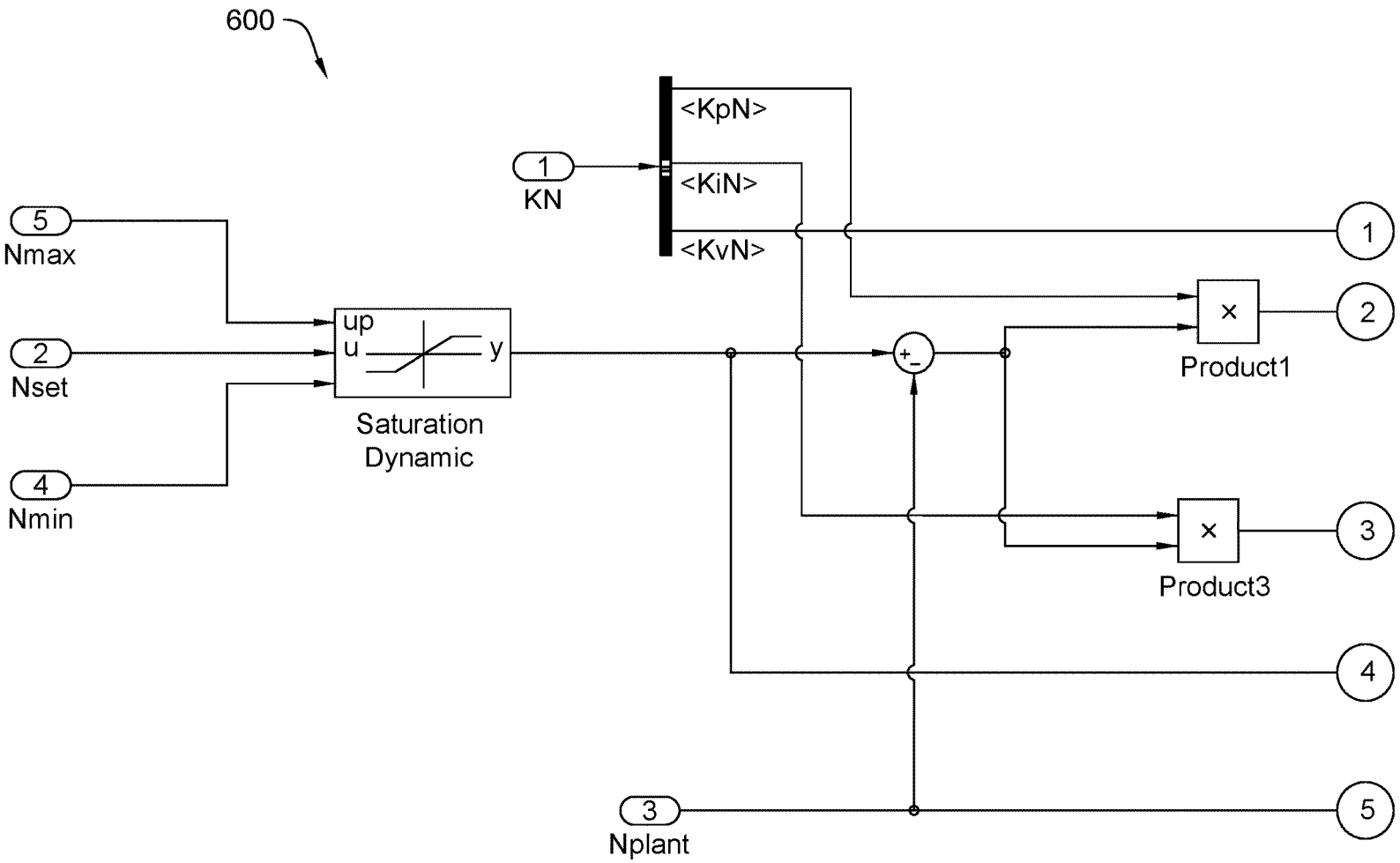
FIGS. 6A and 6B are partial views of the same graphical model showing exemplary procedures for the a PIV feedback controller.
Figure 6B:
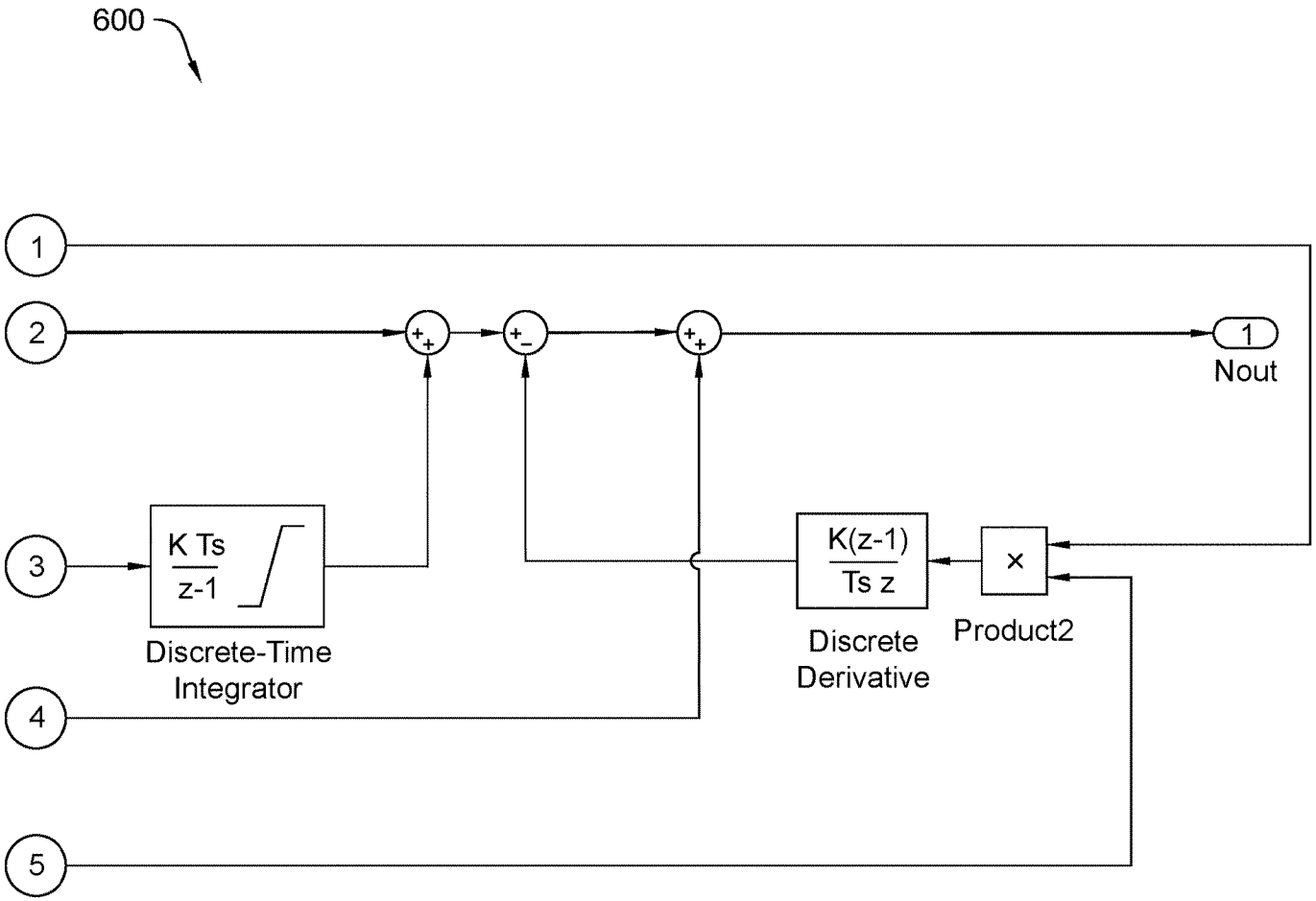

FIG. 6 describes the PIV feedback control model 600 referred to in FIG. 3. This model adjusts the output of the rotation speed control model 300 so that the sensor value Nplant is urged to match the target value VBTarget. The values Nmax, Nset, and Nmin are input to a saturation dynamic block so that the target value VBTarget will be limited to between the maximum and minimum desired values. The target value is fed through to the output to speed response. This latter feature acts as a feed-forward, providing a scaled output directly and not influenced by instantaneous gain values. This makes the feedback loop less sensitive to gain tuning. To improve accuracy, a feedback loop is used to adjust the output. The plant sensor value Nplant is subtracted from the target to measure the error. The error is multiplied by a proportional gain and also by an integral gain and then integrated over time, and the sensor value is multiplied by a derivative gain and the derivative of the sensor value is taken. Proportional and integral values are added and the derivative value is subtracted from the target value to create an adjusted output.

FIG. 7 describes the graphical model for the weight-on-bit (WOB) or feed-force control. This model creates a feed-force setpoint based on input parameters and sensor values. After calculation, a command is output to the actuator of the drilling rig 110, generally, the hoist system 160.

Figure 8:
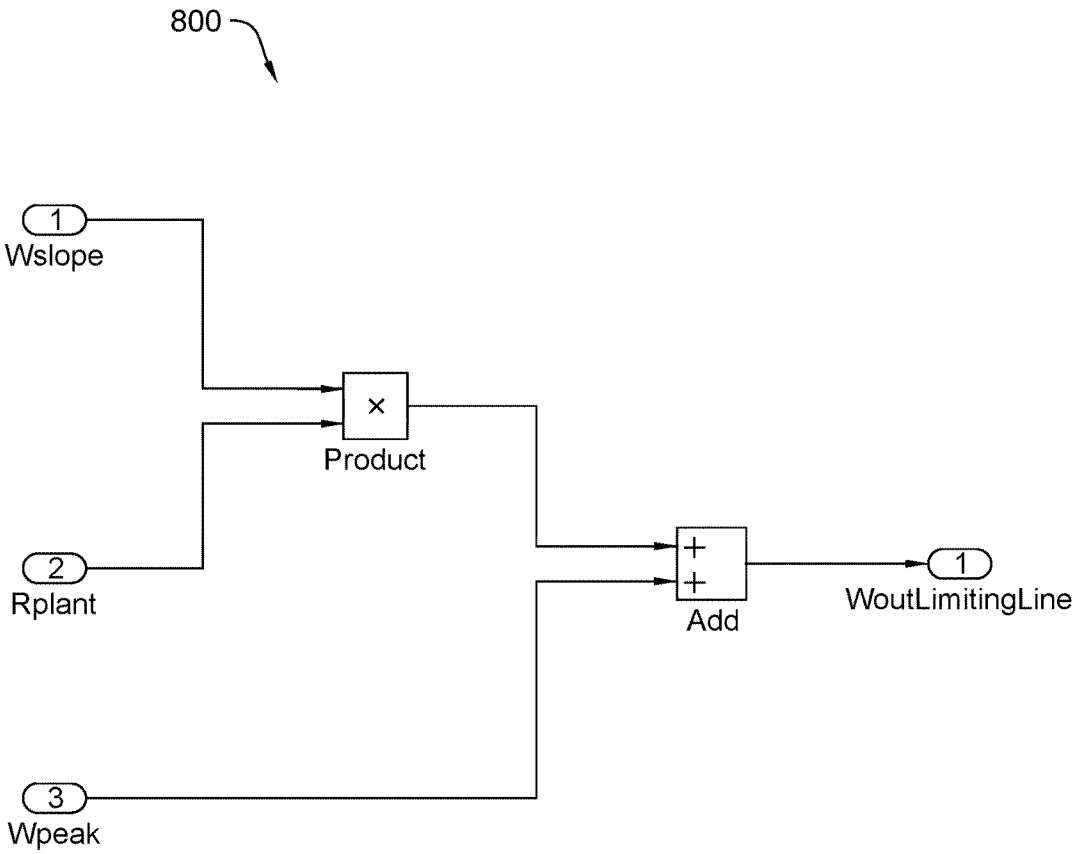
FIG. 8 is a graphical model showing exemplary procedures for details of the weight-on-bit limiting-line calculation.

Table 2 following lists definitions for the various identifiers shown in the graphical models shown in FIGS. 7 and 8, relevant to the procedures for force-feed control.

TABLE 2

| Name | Source | Description |
|---|---|---|
| c | Calculated | AutoDrill is operating in collaring mode at start of hole |
| Hbplant | sensor | current measured hydraulic resistance to feed force from rig kN (kiloNewtons) |
| KW | Parameter | Gain values for feed force feedback loop |
| ParamsRTW | Parameter | signal bus containing gain parameters, max and target values for retraction torque control |
| R | sensor | Current measured feed rate from rig (m/min) |
| Rplant | sensor | Current measured feed rate from rig (m/min) |
| Rton | Output | Digital signal, 1 = retraction torque exception control is active, 0 = not active |
| RTPlant | sensor | Current measured rotation torque from rig kN*m |
| Tsignal | Calculated | commanded feed direction, 1 = feed down (drilling direction), 0 = no feed, −1 = feed up (tripping out direction) |
| WDrillMax | Parameter | Maximum feed force in kN that rig is capable of applying |
| WLowerLim | Calculated | Setting for minimum feed force applied to bit in kN, based on bit manufacturers recommendations for bit type and size, users aggressiveness setting and current number of jams, typically 33% of maximum Wset |
| Wout | Output | Feed force target after scaling, range from 0 to 100% (max rig feed force) |
| WoutLimitingLine | Output | Feed force target in kN which decreases as feed rate increases |
| WoutPIC | Output | Feed force target in kN after adjustment from PIV feedback loop |
| WPeakDrilling | Calculated | Value of feed force limiting line at 0 m/min when drilling, based on bit manufacturers recommendations for bit type and size, users aggressiveness setting and current number of jams |
| WPeak | Calculated | Value of feed force limiting line at 0 m/min when drilling, based on bit manufacturers recommendations for bit type and size, users aggressiveness setting and current number of jams, here it is either the normal or collaring Wpeak |
| WPeakCollar | Calculated | Value of feed force limiting line at 0 m/min when collaring, typically 50% of Maximum Wset |
| Wplant | sensor | Current measured feed force from rig kN |
| WString | Calculated | Calculated weight of drill string which adds to feed force on bit kN |

TABLE 2-continued

| Name | Source | Description |
|---|---|---|
| WSet | Calculated | Setting for maximum feed force applied to bit in kN (kiloNewtons), based on bit manufacturers recommendations for bit type and size, users aggressiveness setting and current number of jams |
| WSlope | Calculated | Reduction in feed force applied per increase in measured feed rate, kN/(m/min) |

Referring to FIG. 7, the graphical model for force-feed or WOB control, the torque exception controller 710 takes the currently-measured torque RTPlant and ParamsRTW (the latter a signal bus containing gain parameters, maximum and target values for retraction torque control) and outputs a target WOB (WsetRT) and a signal Rton indicating torque exception control will be used instead of limiting line control. Torque is controlled by reducing feed force through the torque exception controller 710. This works because rotation torque is in general proportional to feed force while drilling. See FIG. 5 in the discussion of rotation speed control for the general model of an exception controller, used here for torque control.

Further in FIG. 7, a switch determines if collaring mode is on or off. If collaring mode is off, then parameter WPeak is used for the value of the feed force limiting line (explained below). If collaring mode is on, then parameter WPeak collar is used for the value of the feed force limiting line. This value is input to the WOB limiting-line calculation model 800, described below with reference to FIGS. 8 and 8A.

Referring to FIG. 8, the WOB limiting-line calculation model 800 creates a feed-force setpoint based on input parameters and sensor values as follows. The calculation shown is Wout=(Wslope*Rplant)+Wpeak. That is, the feed-force target is the result of multiplying the current feed rate value (Rplant) by the reduction in feed force applied per increase in measured feed rate value (Wslope) and adding the feed force target at zero feed rate, Wpeak. The Wslope value is negative, so feed force decreases as feed rate increases.

Figure 8A:
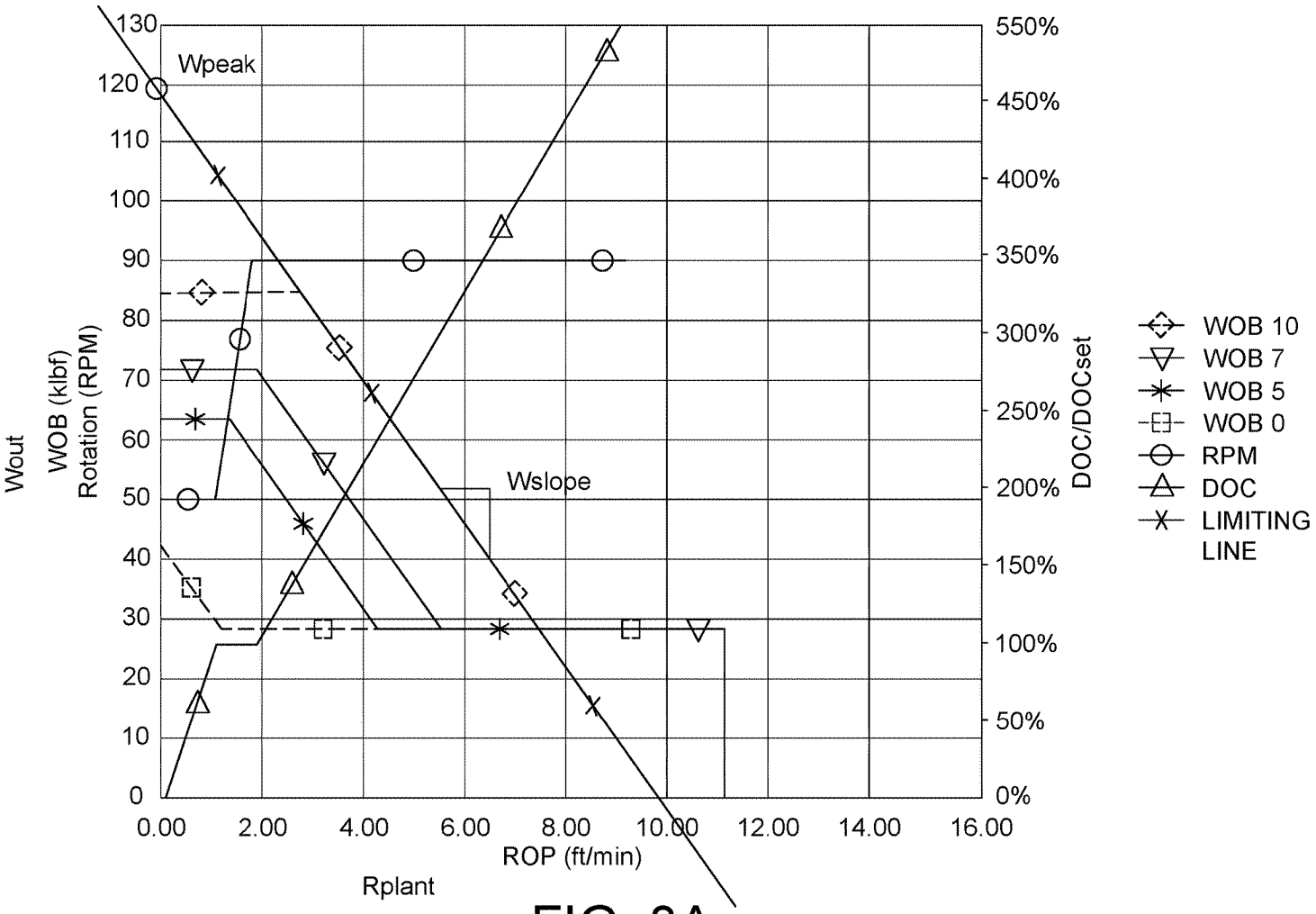
FIG. 8A is a graph illustrating the relationship of the variables in the limiting-line calculation.

A graph of the calculation in the WOB limiting-line calculation model 800 is displayed in FIG. 8A. The WOB limiting-line calculation model 800 calculates the limiting line shown on FIG. 8A based on the Wslope and Wpeak parameters which are calculated from the bit classification database. Wpeak will be reduced for lower aggressiveness settings, resulting in the diagonal portions of exemplary WOB lines denoted WOB 10, WOB 7, and WOB 5 shown in FIG. 8A. Note that the WOB 0 line is equivalent to the collaring Wpeak. In FIG. 8A, the lines for WOB 10, WOB 7, and WOB 5 intersect the Rplant value zero at values for Wset, and all attain a horizontal slope at the value of WLowerLim. From this model, based on the currently-measured feed rate, Wout is calculated.

Returning to FIG. 7, in a saturation dynamic block, the output from the torque exception control block 710 is limited to be between the WOB limiting-line calculation as an upper bound and zero as a lower bound. This upper bound only allows values from the torque exception controller, which reduces feed force. This value is further limited to be between a maximum and minimum feed-force setting appropriate for the selected bit, the upper bound is reduced with a lower aggressiveness setting, shown as the upper left horizontal portion of each WOB lines denoted WOB 10, WOB 7, WOB 5, and WOB 0 on FIG. 8A.

The minimum value is the lower horizontal line which is common to all aggressiveness settings. While retracting, or during retraction anti-jam, the WOB setpoint is used directly, so that feed force will not then be reduced based on penetration rate or measured torque. The PIV feedback controller 715 is used to adjust the output so the plant value matches the target. Finally, in the scaling block 720 shown in FIG. 7, the drill string weight is subtracted from the target value and hydraulic resistance is added to the target value. The adjusted output value is divided by the maximum output value of the drilling rig 110, and the result limited to values between 0 and 1. This value is then output as a percentage command to the hoist actuator 160.

FIG. 9 describes the graphical model for feed-rate control. This model takes as input sensor values and parameters and outputs a feed-rate target for the hoist actuator 160 of the drilling rig 110. Table 3 following lists definitions for the various identifiers shown in the graphical models shown in FIGS. 9, 10, and 11 relevant to the procedures for feed-rate control.

TABLE 30

| Name | Source | Description |
|---|---|---|
| APC_Rset | Calculated | Rate of feed from Air pressure control exception control feedback loop |
| APOn | Output | Digital signal, 1 = feed down high air pressure exception control is active, 0 = not active |
| dAPOn | Output | Digital signal, 1 = feed down rapidly rising air pressure exception control is active, 0 = not active |
| DistToPos | Calculated | Distance from current head position to target head position |
| DNearBottom | Parameter | Distance from hole bottom where slow feed speed should be used, typically set to 1 m |
| KR | Parameter | Gain values for feed rate feedback loop |
| KRTUpR | Parameter | Gain values for retraction torque exception feedback loop |
| On | Calculated | identifies when air pressure control feedback loop feed rate should be used to reduce feed down rate |
| ParamsAPR | Parameter | signal bus containing gain parameters, max and target values |
| RDrillMax | Parameter | maximum feed down rate rig is capable of in m/min |

TABLE 30-continued

| Name | Source | Description |
|---|---|---|
| RDrillMaxUp | Parameter | maximum feed up rate rig is capable of in m/min |
| RFastDown | Parameter | Rate for fast down feed speed, typically rig maximum feed down rate |
| RFastDown | Parameter | Rate for fast down feed speed, typically rig maximum feed down rate |
| RFastUp | Parameter | Rate for fast feed up, typically set to maximum rig feed up rate |
| RFU | Calculated | 1 = use fast feed up, 0 = do not use fast feed up; parameter is 0 when current position is less than DNearBottom from bottom of hole or less than MaxCollarDistance from top of hole, otherwise 1 |
| Rmin | Constant | minimum feed down rate, typically set to 0 m/min |
| ROut | Output | Feed rate target after scaling, range from −100% (max rig feed up rate) to 100% (max rig feed down rate) |
| ROutPIV | Output | Feed rate target after feedback loop adjustments in m/min |
| Rplant | sensor | Current measured feed rate from rig |
| Rpos | Output | calculated feed rate target in m/min from R_position subsystem |
| RSlowUp | Parameter | Rate for slow feed up, typically set to 65 ft/min (about half speed for most rigs) |
| RSlowUp | Parameter | Rate for slow feed up, typically set to 65 ft/min (about half speed for most rigs) |
| RTC_Rset | Calculated | Rate of feed from retraction torque control exception control feedback loop |
| RTMax | Parameter | Rotation torque value where jam escape begins, typically set to 90% of rig capability |
| RTPlant | sensor | Current measured rotation torque from rig |
| RTUpOn | Output | Digital signal, 1 = feed up rotation torque exception control is active, 0 = not active |
| RTUpTarget | Parameter | Rotation torque value where retraction jam prevention begins, typically set to 50% of rig capability |
| RUpmin | Constant | Minimum feed up rate, typically set to −2 m/min to allow feeding down to escape a retraction jam |
| Rvoid | Parameter | Rate for slow down feed speed, scales to bit type and diameter, typically 4x optimal DOC feed speed, limits speed to prevent runaway if a void is encountered while drilling, also used to slow feed before re-engaging rock when returning to drilling after cleaning or jamming |
| Tsignal | Calculated | commanded feed direction, 1 = feed down (drilling direction), 0 = no feed, −1 = feed up (tripping out direction) |

Referring to FIG. 9, the inputs and constants shown in the feed rate model 900 pass to an air-pressure exception control block 910 and a torque retract exception control block 920, which exception control blocks have the same function as described in FIG. 5, with different input variables here. The air pressure exception control block is used for air pressure jam prevention by reducing feed down rate when air pressure is high or rising quickly. This slows generation of new cuttings and allows for a blockage to clear. Air pressure parameters are used for the jam prevention variables and feed down rates are the control variables. The torque-retract exception control block is used for retraction torque jam prevention by reducing feed up rate when torque is high while retracting. Rotation torque parameters are used for the jam prevention variables and feed up rates are the control variables. Outputs from these blocks and the input variables indicated are input to the Regulate Rset block 930, described further in FIG. 10. The output of the Regulate Rset block 930 is scaled as shown, such that the adjusted output value is divided by the maximum output value for the drilling rig 110, and the result is limited to values between 0 and 1 for feed up, or 0 and −1 for feed down. This value is then output as a percentage command to the motor 150 of the drilling rig.

Figure 10A:
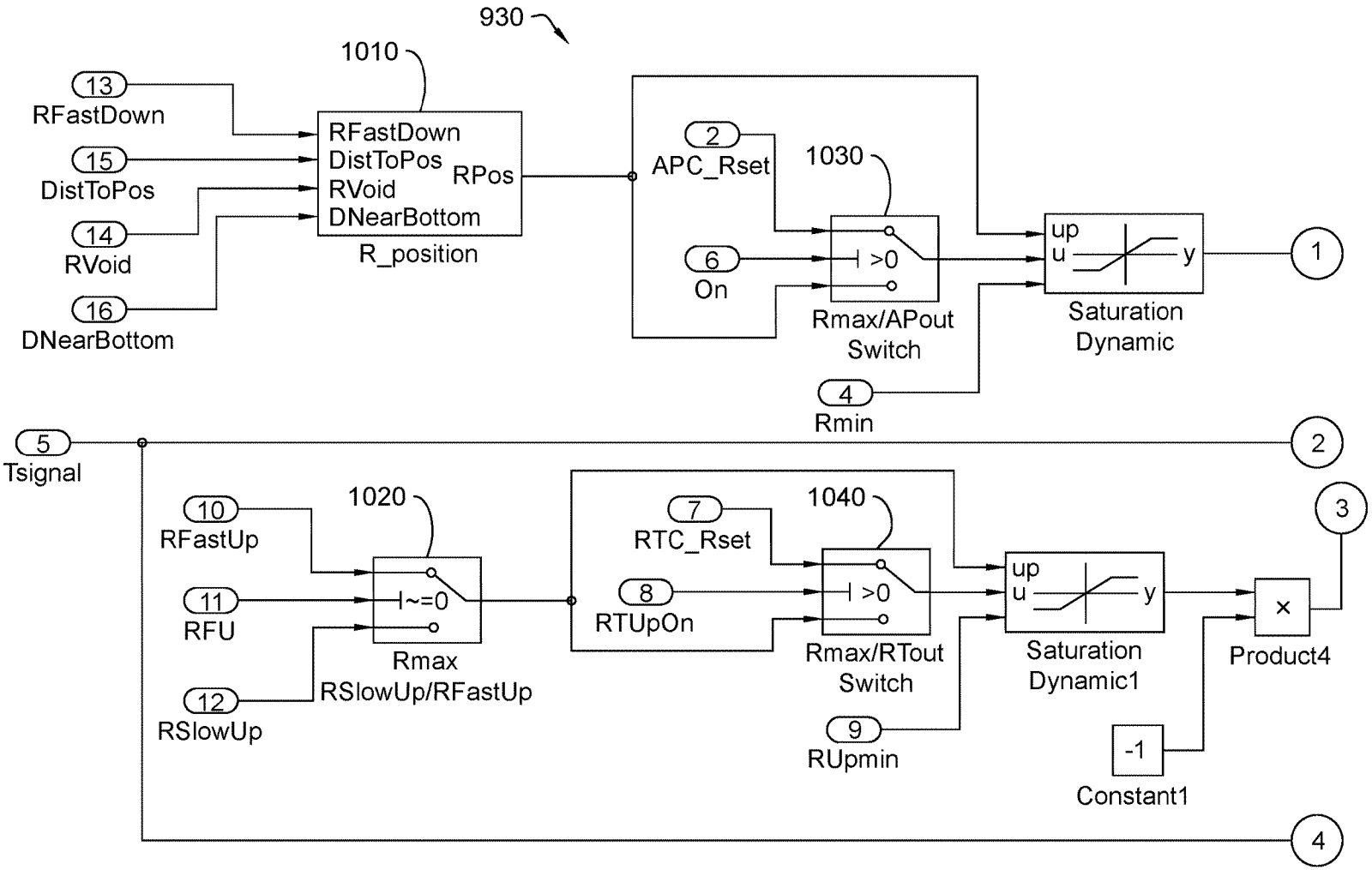
FIGS. 10A and 10B are partial views of the same graphical model showing exemplary procedures for a feed-rate control sub-model.
Figure 10B:
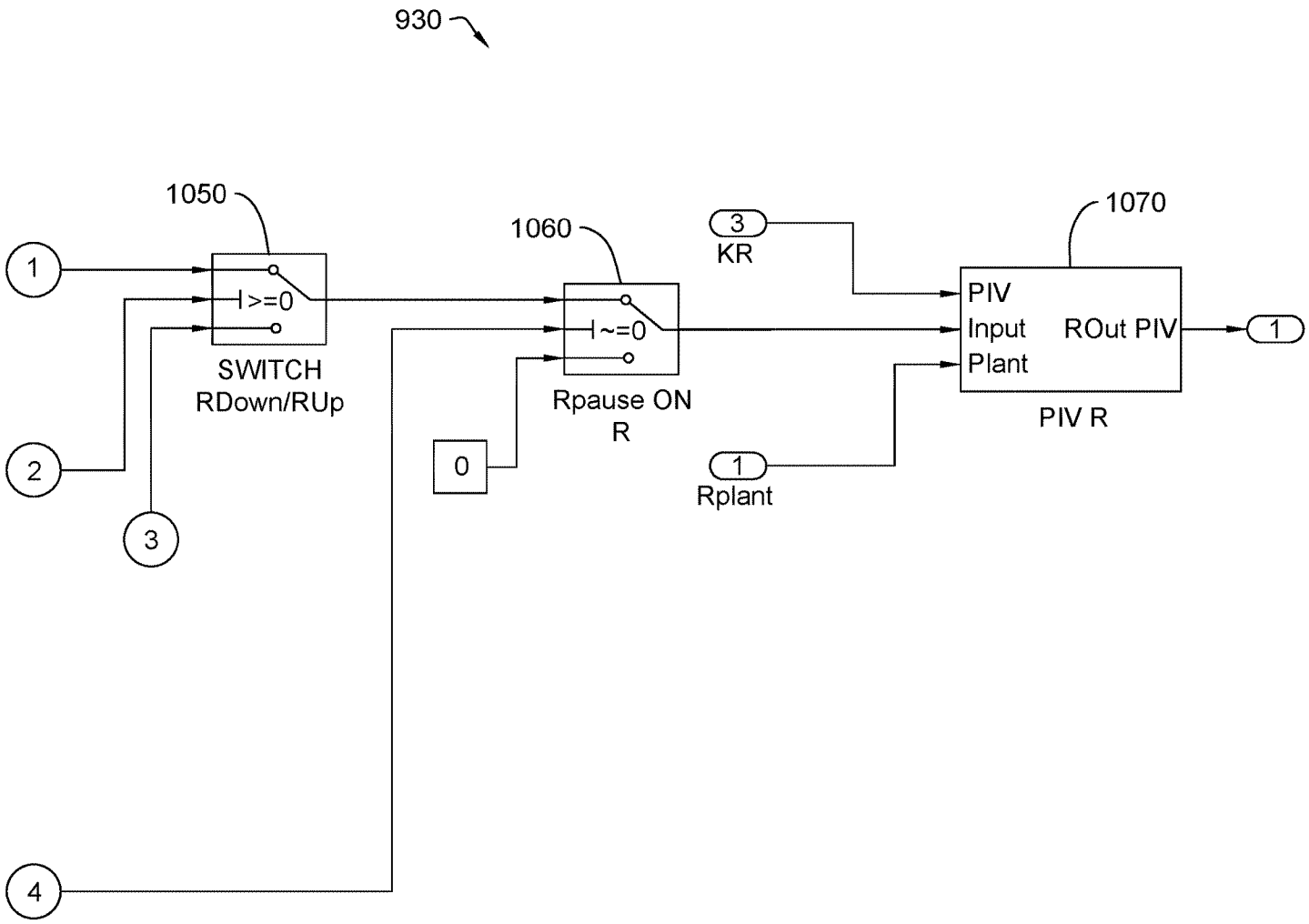

The Regulate Rset block 930 is shown in the graphical model of FIG. 10. This block receives input sensor values and parameters and outputs a feed rate target, based on a direction command, the position in the hole, and whether air pressure or retraction torque exception controllers are active.

Figure 11:
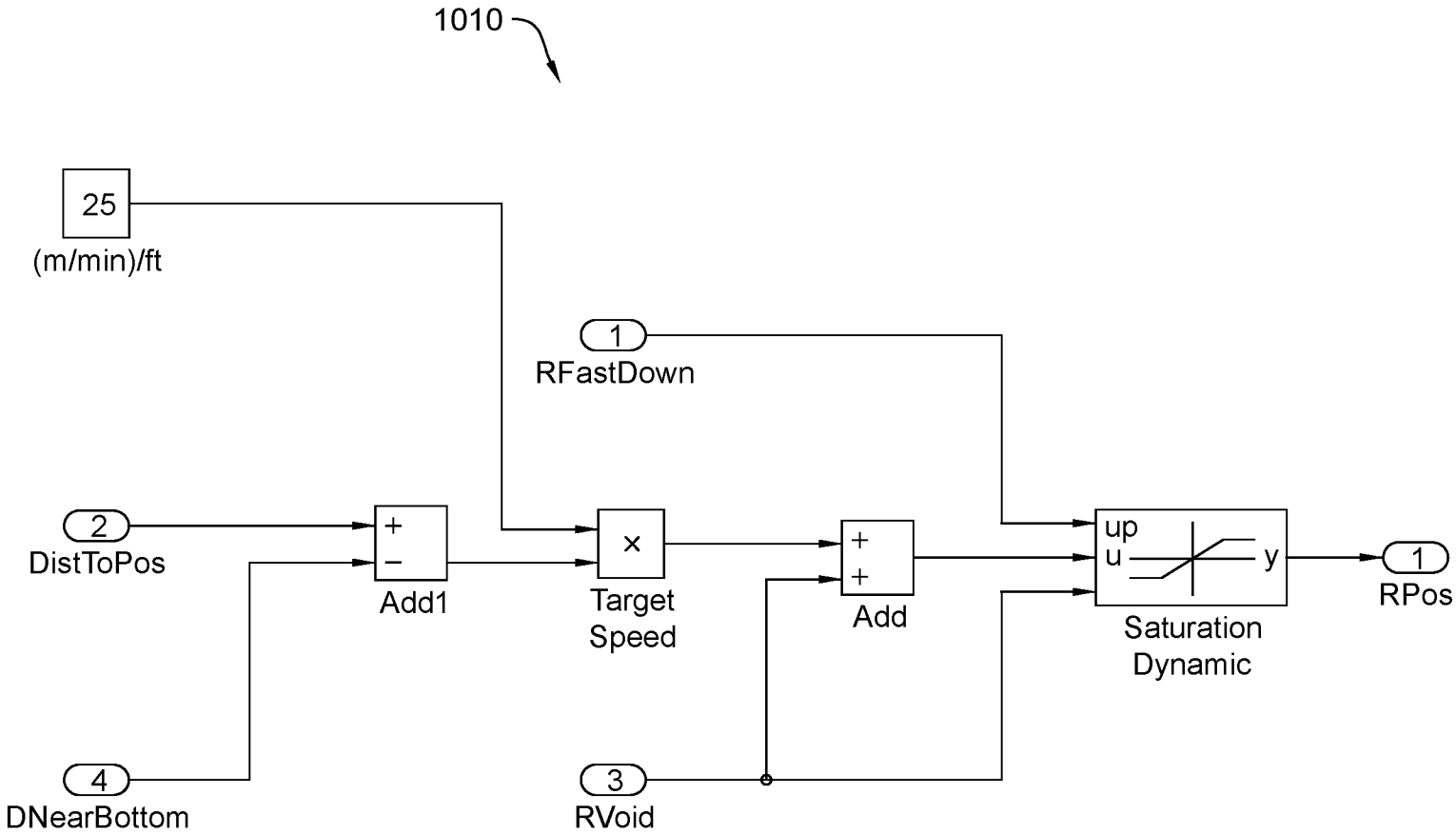
FIG. 11 is a graphical model showing exemplary procedures for a positioning control sub-model.

The R_position block 1010 shown in FIG. 10 allows for fast feed-down when far from the hole bottom and a proportional ramp down in feed speed to a controlled lower feed rate when approaching the hole bottom. Referring now to FIG. 11 illustrating the R_position block 1010, the variable DNearBottom is the distance from the bottom of the hole where the lower feed speed should begin. This is subtracted from the current distance to the position and multiplied by a factor so that the further the current position is from the target position, the faster the target speed will be. A minimum desired speed is added to this target speed. Then the target is bound to be between a maximum fast feed speed and the minimum target speed.

Returning to FIG. 10, if Air Pressure Control is active, the target feed speed from the Air Pressure exception controller is used, otherwise the R_position feed speed target is used (see switch block 1030). The value is then bound to be between the R_position value and 0. In the feed up direction (see switch block 1020), a slow feed target is set when near the top or bottom of the hole, otherwise a fast feed speed target is used. Referring to switch block 1040, if retraction torque control is active, the target feed speed from the retraction torque exception controller is used; otherwise the feed up speed target is used. The value is then bound to be between the feed up target speed and a minimum value which allows reversal of feed to escape a high torque condition. Referring to switch block 1050, a command signal of 1 sets the controller to use the feed down speed target. A command signal of less than zero sets the controller to use the feed up speed target. Note that the feed-up signal is multiplied by −1 because negative actuations represent feed up. In switch block 1060, a command signal of 0 sets the feed speed target to zero. Finally in PIV feedback controller block 1070, the output signal is adjusted so that the plant value matches the computed target value. Details of a typical PIV feedback controller block may be found in FIG. 6 above.

Figure 12A:
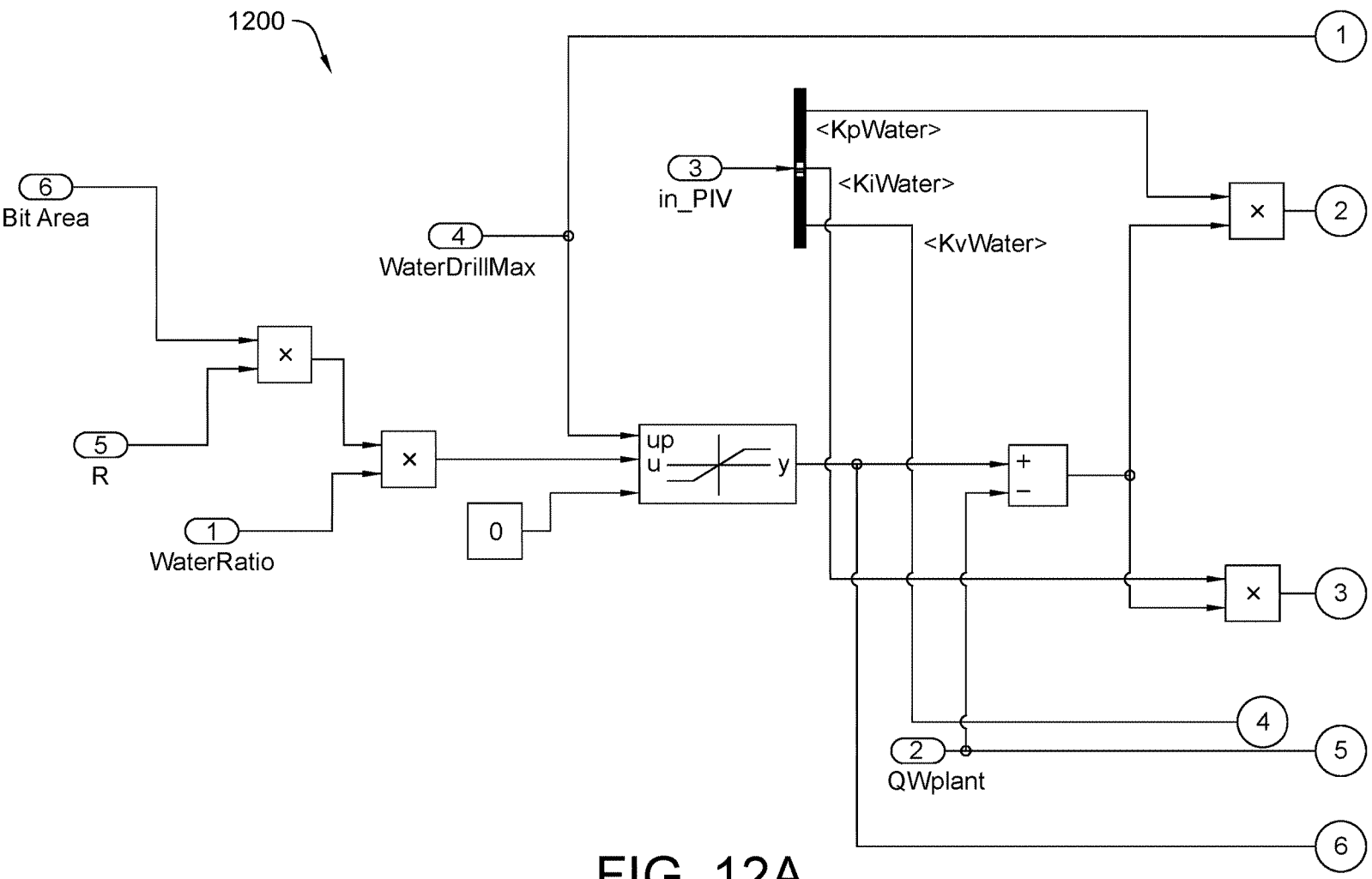
FIGS. 12A and 12B are partial views of the same graphical model showing exemplary procedures for the control of water injection.
Figure 12B:
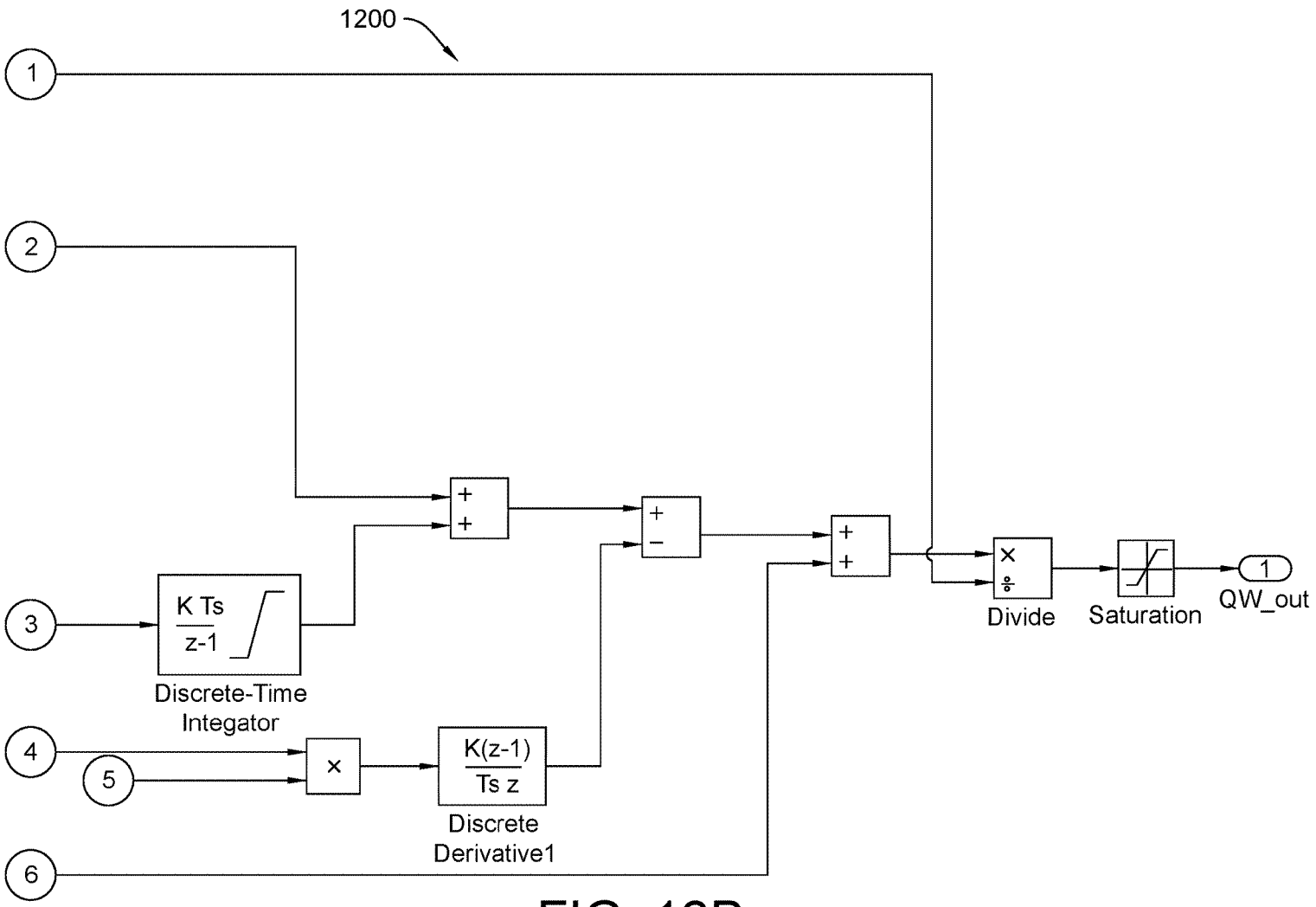

FIG. 12 describes the graphical model for water flow control 1200. This model takes sensor and parameter inputs to calculate a water flow command Table 4 following lists definitions for the various identifiers shown in the graphical model shown in FIG. 12 relevant to the procedures for water-flow control.

TABLE 4

| Name | Source | Description |
|---|---|---|
| BitArea | Parameter | Drill bit/hole area in m^2 |
| KiWater | Parameter | Integral gain for water flow control |
| KpWater | Parameter | Proportional gain for water flow control |
| KvWater | Parameter | Derivative gain for water flow control |
| QW_out | Output | Water flow command output to actuator scaled from 0 to100% (rig maximum) |
| Qwplant | sensor | Current measured water flow rate (l/min) |
| R | sensor | Current measured feed rate from rig (m/min) |
| WaterDrillMax | Parameter | Maximum water flow capability of rig (l/min) |

Referring to FIG. 12, the model 1200 shows how the target water flow rate is calculated by determining flow rate of material excavated from the borehole by first multiplying bit area by current rate of penetration. This value is then multiplied by the desired proportion of water to be applied resulting in a liters/min target water flow rate. The target water flow is then limited to be between the maximum water flow capability of the drilling rig and zero, so that the feedback controller will only receive achievable values. As shown in the water-flow control model, the target value is fed through to the output to speed response of the control loop. To improve accuracy, a feedback loop is used to adjust the output. The plant sensor value is subtracted from the target to measure the error. The error is multiplied by a proportional gain, then the error is multiplied by an integral gain, and then integrated over time, and the sensor value is multiplied by a derivative gain and the derivative of the sensor value is taken. Proportional and integral values are added and derivative value is subtracted from the target value to create an adjusted output. The adjusted output value is divided by the maximum output value of the drilling rig 110 and the result limited to values between 0 and 1. This value is then output as a percentage command to the water-flow actuator 240 of the drilling rig 110.

FIG. 13 describes the graphical model for air-flow control 1200. This model takes sensor and parameter inputs to calculate an air flow command Table 5 following lists definitions for the various identifiers shown in the graphical model shown in FIG. 13 relevant to the procedures for air-flow control.

TABLE 5

| Name | Source | Description |
|---|---|---|
| APMin | Parameter | Minimum air pressure target (bar) |
| In_AP | sensor | current measured bit air pressure (bar) |
| KiAPMin | Parameter | Integral gain for minimum air pressure control |
| KpAPMin | Parameter | Proportional gain for minimum air pressure control |
| KvAPMin | Parameter | Derivative gain for minimum air pressure control |
| Q_Air_In | Calculated | Target airflow setting in % of capacity based on bailing velocity target |
| Q_Air_Out | Output | Target airflow setting output in % of capacity |

Referring to FIG. 13, the graphical air-flow control model 1300, a minimum desired bit air pressure is sent to the controller (variable APMin). The APMin value varies with the aggressiveness setting. A baseline minimum air pressure is used for minimum aggressiveness and the minimum pressure increased for each increase in the aggressiveness setting. For rotary drilling about 34 psi is preferably used at minimum aggressiveness, and the pressure target raised about 5 psi for each increase in aggressiveness. When collaring, the minimum air pressure setting is set to the minimum aggressiveness value. To improve accuracy, a feedback loop is used to adjust the output. The target value is fed through to the output to speed response of the control loop. The plant sensor value is subtracted from the target to measure the error. The error is multiplied by a proportional gain, then the error is multiplied by an integral gain, and then integrated over time, and the sensor value is multiplied by a derivative gain and the derivative of the sensor value is taken. Proportional and integral values are added and derivative value is subtracted from the target value to create an adjusted output.

Further, as shown in FIG. 13, a target bailing velocity is calculated by multiplying a baseline value by three adjustment factors, one for rate of penetration, one for drill hole angle and one for water injection. All of these factors can reduce the ability to remove cuttings from the hole so more airflow is used to compensate. A recommended bailing velocity range is also stored in the database and displayed on the GUI. This range is preferably set to about 5,500-12,000 ft/min. The rate of penetration adjustment is based on the rate of penetration where the system begins to reduce weight on bit, thus lower aggressiveness settings will result in lower bailing velocity targets. The airflow target is increased about 50% per each meter/minute of target drilling speed increase. The water flow adjustment increases airflow by about 10% if water injection is used in the process. The angle adjustment increases airflow by about 0.5% per degree of inclination from vertical. When collaring, the bailing velocity target is set to the minimum aggressiveness value. The air flow target from the minimum pressure feedback loop is subtracted from the target airflow setting based on bailing velocity calculation. If the value is positive, indicating the bailing velocity airflow is higher, the bailing velocity target will be used. If the value is negative indicating the minimum pressure airflow target is higher, the minimum pressure value will be used. The adjusted output value is divided by 100 and the result limited to values between 0 and 1. This value is then output as a percentage command to the air-flow actuator 230 of the drilling rig 110.

CONCLUSION

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

I claim:

1. A method for drilling a borehole using a drilling rig having at least one rotary drill bit, the method comprising:

monitoring one or more drilling parameters;

determining whether the one or more monitored drilling parameters are within predetermined specifications for one or more of the monitored drill parameters; and, executing a exception control procedure for control of a drilling parameter; the exception control procedure comprising:

receiving at least one input sensor value associated with at least one drilling parameter;

subtracting a target value from the at least one input sensor value to establish an error value;

dividing the error value by the range between a pre-determined maximum for the at least one input sensor value and the target value to establish a scaled error value;

multiplying the scaled error value by a proportional gain to give a first output value;

applying feedback control to the first output to minimize the first output value;

and adding 1 to the minimized first output value to give an adjusted minimized first output value;

subtracting a lower limit for the at least one input sensor value from a current setpoint for the at least one input sensor value to give an adjusted setpoint for the at least one input sensor value;

multiplying the adjusted setpoint for the at least one input sensor value by the adjusted minimized first output value and adding the result of the multiplying of the adjusted setpoint for the at least one input sensor value by the adjusted minimized first output value to the lower limit for the at least one input sensor value to give a setting value for the at least one drilling parameter.

2. The method of claim 1 where the step of applying feedback control to minimize the first output value comprises:

multiplying the first output value by an integral gain to give a second output;

integrating the second output over time to produce a third output;

adding the first output to the third output to give a fourth output;

multiplying the at least one input sensor value by a derivative gain to give a fifth output;

differentiating the fifth output to give a sixth output; and;

adding the fourth output to the sixth output to give a minimized first output value.

3. The method of claim 1, where the drilling parameter to be controlled by the exception control procedure is rotation speed of the drill bit.

4. The method of claim 3, where the input sensor value comprises the lateral vibration of the drilling rig.

5. The method of claim 1, where the drilling parameter to be controlled by the exception control procedure is feed rate of the drill bit.

6. The method of claim 5, where the input sensor value comprises the drilling rig air pressure.

7. The method of claim 1, where the drilling parameter to be controlled by the exception control procedure is weight-on-bit.

8. The method of claim 7, where the input sensor value comprises the current measured rotation torque of the drill bit.

9. The method of claim 1, where the drilling parameter to be controlled by the exception control procedure is rotation torque during retraction of the drill bit.

10. The method of claim 9, where the input sensor value comprises drilling rig rotation torque.

11. The method of claim 1, where an indication of the minimized first output value is selectively chosen for display to an operator depending on whether jam-prevention control has been selected by the operator, and the indication of the minimized first output value indicates to the operator if jam-prevention control is activated or not.

* * * * *